US007870688B1

(12) United States Patent
Dasiukevich

(10) Patent No.: US 7,870,688 B1
(45) Date of Patent: Jan. 18, 2011

(54) CLAMPING DEVICE FOR COAXIALLY COUPLING OPTICAL DEVICES

(75) Inventor: Vladimir Dasiukevich, Isle of Barrn (GB)

(73) Assignee: Night Optics USA, Inc., Huntington Beach, CA (US)

( * ) Notice: Subject to any disclaimer, the term of this patent is extended or adjusted under 35 U.S.C. 154(b) by 1343 days.

(21) Appl. No.: 11/347,465

(22) Filed: Feb. 3, 2006

(51) Int. Cl.
*F41G 1/38* (2006.01)

(52) U.S. Cl. ..... 42/124; 248/229.1; 248/229.14; 248/229.24; 248/230.5; 248/231.61; 42/125; 42/126; 42/127; 42/114; 42/115; 42/142; 42/146; 42/116; 42/117

(58) Field of Classification Search ..... 248/229.1, 248/229.14, 229.24, 230.5, 231.61; 42/124–128, 42/114–117, 142, 146
See application file for complete search history.

(56) References Cited

U.S. PATENT DOCUMENTS

| | | | | | |
|---|---|---|---|---|---|
| 1,280,095 | A * | 9/1918 | Smith | 248/230.5 |
| 1,837,290 | A * | 12/1931 | Redfield | 42/127 |
| 2,202,000 | A * | 5/1940 | Gray | 42/124 |
| 2,425,130 | A * | 8/1947 | Shelley | 42/16 |
| 2,445,087 | A * | 7/1948 | Rogers | 42/128 |
| 2,527,289 | A * | 10/1950 | Allen | 42/128 |
| 2,529,801 | A * | 11/1950 | Fisk | 42/128 |
| 2,644,237 | A * | 7/1953 | Pachmayr | 42/128 |
| 2,710,453 | A * | 6/1955 | Beverly | 42/128 |
| 2,803,880 | A * | 8/1957 | Weaver | 42/128 |
| 2,825,138 | A * | 3/1958 | Ivy | 42/124 |
| 2,951,292 | A * | 9/1960 | Buehler | 42/126 |
| 3,226,868 | A * | 1/1966 | Mahoney | 42/128 |
| 4,016,652 | A * | 4/1977 | Stratman | 42/137 |
| 4,161,835 | A * | 7/1979 | Lough | 42/114 |
| 4,461,087 | A * | 7/1984 | Norman | 42/128 |
| 4,957,318 | A * | 9/1990 | Blatt | 294/64.1 |
| 5,405,113 | A * | 4/1995 | Jaw | 248/229.1 |
| 5,745,170 | A * | 4/1998 | Palmer | 348/217.1 |
| 5,816,736 | A * | 10/1998 | Kroulik | 403/389 |
| 6,449,419 | B1 * | 9/2002 | Brough et al. | 385/136 |
| 6,481,146 | B2 * | 11/2002 | Carrier, III | 42/136 |
| 6,775,942 | B2 * | 8/2004 | Compton | 42/85 |
| 6,792,711 | B2 * | 9/2004 | Battaglia | 42/114 |
| 6,937,819 | B2 * | 8/2005 | Brough | 396/429 |
| 7,134,234 | B1 * | 11/2006 | Makarounis | 42/146 |
| 7,272,904 | B2 * | 9/2007 | Larue | 42/127 |
| 7,367,152 | B2 * | 5/2008 | Samson | 42/128 |
| 7,441,364 | B2 * | 10/2008 | Rogers et al. | 42/146 |
| 7,533,597 | B1 * | 5/2009 | Strohman | 86/50 |

(Continued)

*Primary Examiner*—Anita M King
*Assistant Examiner*—Nkeisha J Smith
(74) *Attorney, Agent, or Firm*—William L. Chapin

(57) ABSTRACT

A clamping device for coupling optical devices in coaxial, tandem alignment includes a front clamp assembly that has elastically deformable split collar halves tightenable onto a front optical device by a screw tightenable into bores disposed transversely through a pair of arms extending radially from the split collar halves. A rear optical device support protrudes rearward from the front clamp assembly, and has a releasable fastener such as a screw or dovetail joint for supporting a rear optical device in coaxial alignment with the front optical device. Preferably, the arm is mounted to the front clamp assembly by means of a pivotable joint which is latchable in a first, rearward position, and a second, forward position in which the rear optical device is positioned along the side of the front optical device, so that the front device may be used independently of the rear device.

28 Claims, 22 Drawing Sheets

U.S. PATENT DOCUMENTS

2003/0080267 A1* 5/2003 Eslick ..... 248/229.1
2008/0072471 A1* 3/2008 Keng ..... 42/124
2009/0288328 A1* 11/2009 Kiser ..... 42/124

* cited by examiner

CLAMPING DEVICE FOR COAXIALLY COUPLING OPTICAL DEVICES

BACKGROUND OF THE INVENTION

A. Field of the Invention

The present invention relates to devices for coupling together a pair of optical devices, such as a night-vision device to a telescopic sight mounted on a rifle. More particularly, the invention relates to a versatile clamping device for releasably and coaxially coupling an auxiliary optical device such as an infrared viewer, image intensifier, or other such night vision device used to enhance viewability of objects in dark environments, to a riflescope of the type useful primarily for daylight conditions, thus adapting the riflescope for night-time use.

B. Description of Background Art.

A typical riflescope of the type used by hunters, law enforcement personal, and members of the military, comprises essentially a Galilean telescope which is provided with an internal sighting reticle. Most riflescopes have a longitudinally elongated, main tube, a short, front tubular objective lens assembly of a larger diameter joined to the main tube by a tapered frusto-conically-shaped front transition section, and a short, rear tubular eye-piece or ocular section holding an eyepiece, lens assembly, the rear tubular section being of a diameter intermediate that of the objective end piece and main tube, and joined to the latter by a rear tapered transition section.

A riflescope includes a mounting system for attaching it to a rifle, such as a mounting base which protrudes downwardly from the main tubular section of the riflescope and is adapted to be attached to a rifle mount that protrudes upwardly from the barrel of a rifle. The riflescope mount and rifle mount are so constructed as to enable the riflescope to be securely attached to the rifle, with the optical axis maintained substantially parallel to the bore axis of the rifle, using an elongated interlocking dove-tailed rail and channel, for example.

As can be readily understood, the function of a riflescope is to provide a magnified image of a distant target, to thereby facilitate aligning the trajectory of a bullet fired from the rifle with an intended location on a target. Thus, a riflescope is provided with some sort of visual indicator which is superimposed on a distant target and viewable through the eyepiece. Typically, the visual indicator is a reticle which has two or more perpendicular cross-hairs that intersect in the center of the field of view of the riflescope. Ideally, the intersection point of the reticle cross hairs on a target at a particular distance or range coincides with the impact point of a bullet fired from a rifle to which the riflescope is attached. However, since the trajectory of a bullet is a parabolic curve, rather than a straight line, the bullet impact point can be made to coincide precisely with the cross-hair intersection point on a distant target only at a specific range, e.g., 100 or 200 yards.

As a practical matter, if the ratio of muzzle velocity to weight of the fired bullet is sufficiently high, a bullet has a relatively flat trajectory, so that angular height deviations between the bullet impact point and the cross-hair intersection on a target will be tolerably small for reasonably large variations in range.

To enable alignment of the cross-hair intersection of a riflescope with the impact point of a rifle on which the riflescope is mounted, the riflescope contains a mechanism for aligning a line of sight defined by the eye and cross-hair intersection relative to the bore axis of the rifle. An alignment procedure, called boresighting, is generally accomplished by using a riflescope alignment adjustment mechanism which includes a pair of perpendicularly arranged, knurled thumb knobs which are mechanically coupled to horizontal and vertical cross-hairs. These include a first, elevation adjustment thumb knob which has a vertically disposed axis that protrudes upwardly from the upper surface of the central tubular section of the riflescope, at a location between the front and rear ends of the riflescope. The elevation thumb knob is rotatable in a horizontal plane in a clockwise or counterclockwise sense to raise or lower a horizontal cross-hair axis relative to the bore of the rifle.

Similarly, a typical riflescope includes a second, windage adjustment thumb knob which has a horizontally disposed axis that protrudes horizontally outwards from a side, e.g., right side, of the central tubular section of the riflescope, in transverse alignment with the elevation adjustment thumb knob. The windage adjustment thumb knob is rotatable in a vertical plane in clockwise and counterclockwise senses to move a vertical cross-hair aim point left or right relative to the bore of the rifle.

A customary method of boresighting a riflescope mounted on a rifle involves the steps of adjusting the elevation and windage thumb knobs to nominal values, firing the rifle at a target, noting the impact point of the bullet, re-adjusting the elevation and windage knobs to bring the aim point of the riflescope into closer coincidence with the bullet impact point on the target, firing the rifle again, and repeating the foregoing steps as many times as necessary to achieve a desired proximity between cross-hair aim point and bullet impact point.

When a rifle is to be fired at a target which differs substantially in range from the sight-in range used to boresight the riflescope to the rifle, the elevation angle of the cross-hairs may be raised or lowered to raise or lower the trajectory of the bullet a predetermined amount relative to the cross-hair aiming point, by turning the elevation knob in angular increments indicated by alignment of a particular one of a series of numbered fiduciary marks on the elevation knob with an index marker fixed to the riflescope tube. Similarly, in the presence of transverse cross winds, the windage adjustment thumb knob may be used to deviate the cross-hair aim point toward the direction of the wind, thus ensuring that the vector sum of trajectory of a bullet from the muzzle of the rifle, and the transverse deviation of the trajectory caused by wind result in an impact point close to a desired impact point on a target.

It should be noted that the angular adjustments of elevation and windage both for boresighting and adjusting to varied range and wind conditions, are quite critical. Thus, a deviation of only 0.095 degrees results in a one-foot deviation of a bullet impact point at 200 yards. Accordingly, it is important than the optical axis of the riflescope be maintained in a very rigid, stable, orientation relative to the bore of a rifle on which it is mounted.

Magnification of a target image using a typical riflescope substantially increases the range over which an average shooter can accurately fire on a target, as compared to the shooters use of mechanical sights which do not employ magnifying lenses, i.e., "iron sights." However, the use of conventional telescopic riflescopes under low-light level conditions, e.g., at dusk or dawn, can be problematic for the following reasons.

Although a riflescope can in principle utilize any combination of magnifying power and objective lens size, practical considerations such as size and weight place limits on the foregoing parameters. Thus, a typical riflescope utilizes a 42 mm diameter objective lens, and has a magnification ratio of 10× and is thus designated 10×42. Now, the light gathering power of a telescopic sight or similar optical instrument is directly proportional to the area of the objective lens, and is inversely proportional to the magnification factor of the sight. Also, as a rough rule of thumb, it has been determined that a 7×50 telescope, such as the dual telescopes of 7×50 binoculars, provides an image brightness approximating that of an image viewed directly by the eye. Thus, the brightness of an image formed on the eye by a 10×42 riflescope, a riflescope having a smaller, 42 mm objective lens and a higher, 10× magnification factor, is substantially less than the brightness of an image formed on the eye using iron sights.

Also, there are a variety of situations in which it is desirable to be able to fire a rifle on a target in lighting conditions which would be impractical even using iron sights, i.e., at night. For such applications, a special type of riflescope called a "snooperscope" was developed many years ago. The original snooperscope employed an infrared converter vacuum tube which converts an infrared image incident upon a photo emissive surface responsive to infrared photons, to electrons which are accelerated by a high voltage and impinge on phosphor screen to thereby produce a greenish, florescent image of a target. This type of device required an infrared illuminator to illuminate a target.

Modern night vision riflescopes utilize more sophisticated infrared image devices, and/or image intensifiers which have a sufficiently high brightness amplification factor that minuscule levels of target illumination provided by starlight are sufficient to produce an image of a target, hence the name "starlight scope."

Whatever imaging technology is utilized to obtain an image of a target in low light level conditions, the requirement for maintaining the line of sight of the imaging device stably aligned with the bore of the rifle on which the device is mounted remains. Accordingly, utilization of such devices requires that they be either semi-permanently mounted to a rifle, or removably mounted to the rifle in a manner which ensures that the device will be remounted to a precisely predetermined, bore-sighted orientation relative to the rifle bore axis, each time it is replaced after removal. It should be noted that a typical night vision riflescope cannot be used during daylight conditions because the high light amplification of such devices results in overly bright, low contrast image under normal ambient lighting conditions. Also, some low-light level devices can be permanently damaged by normal levels of illumination.

For the foregoing reasons, it is generally necessary to provide a rifleman with separate daylight and night vision riflescopes, requiring the rifleman to substitute one for the other when shifting between nighttime and daytime tactical operations. Therefore, it would be highly desirable to provide a device which would enable night vision devices to be removably attached in precise coaxial alignment with a daylight riflescope which was semi-permanently mounted and accurately bore-sighted to a rifle, thus enabling the rifle to be used in both daytime and nighttime lighting conditions.

Brough et al, U.S. Pat. No. 6,449,419, discloses a clamping device for coaxial coupling two optical viewing devices, which has a pair of longitudinally spaced apart split collars, each of which has a bore diameter reducible into clamping engagement with the barrel of an optical device inserted into the bore, by means of a toggle clamp which releasably draws more closely together a pair of circumferentially spaced apart cylindrical ring segments. However, there remains a need for a clamping device for optically coupling a relatively long, heavy auxiliary optical device such as a night vision scope, to a riflescope, which includes means for preventing the long, unsupported moment arm of the device from causing deviation in optical alignment between the riflescope and optical accessary device, as a result of gravitational force acting on the unsupported device, and/or inertial torques exerted on the accessory device relative to the riflescope as a result of accelerating motions of a rifle during maneuvers. Also, it would be desirable to have a clamping device for maintaining an accessory optical device in precise coaxial alignment with a riflescope, and which would also enable the accessory device to be quickly and easily swung away from the riflescope to enable direct viewing through the riflescope, and swung back into a precise coaxial optical alignment with the riflescope, to enable coupled use of the devices.

The present invention was conceived of to provide such a device.

OBJECTS OF THE INVENTION

An object of the present invention is to provide a clamping device for releasably coupling an optical accessory device to a telescopic rifle sight, i.e., riflescope, with an optical axis of the accessory device coaxially aligned with the optical axis of the riflescope.

Another object of the invention is to provide a clamping device for coaxially coupling an optical accessory device such as a night vision scope to a riflescope, thereby enabling the riflescope to be used in low ambient light conditions.

Another object of the invention is to provide a clamping device for coaxially coupling an optical accessory device such as a night vision scope to a riflescope, the device utilizing a front mounting collar which is coaxially clampable over the rear ocular barrel of a telescopic rifle sight, and a rearwardly extending arm releasably attachable to a night vision device, with a front objective lens barrel located coaxially within a rear mounting ring which protrudes rearward form the front mounting collar.

Another object of the invention is to provide a clamping device for coaxially coupling an optical accessory such as a night vision scope to a riflescope, the device having a front mounting collar which is coaxially clampable over the rear ocular barrel of a telescopic rifle sight, a mounting ring which protrudes rearwardly and coaxially from the front mounting collar and adapted to receive the front tubular end of an optical accessory such as a night vision device, and an arm which protrudes axially rearwardly from an outer surface of the collar/mounting ring assembly, the arm being releasably fastenable to the body of an accessory device.

Another object of the invention is to provide a clamping device for coaxially coupling an optical accessory such as a night vision device to a riflescope, the clamping device having a front mounting collar which has a front entrance bore for receiving rearwardly therein a rearwardly projecting ocular barrel of a riflescope, the front mounting collar having a releasable clamping mechanism for clamping the riflescope ocular barrel coaxially within the entrance bore of the collar, and a rear mounting ring which protrudes rearwardly from the collar and has a rear cylindrical entrance bore adapted to coaxially receive therein the front tubular end of an optical accessory device, such as the front objective lens barrel of a night vision device, and one or a pair of accessory device holding arms, which protrude from an outer surface of the rear mounting ring axially rearwardly and parallel to the longitudinal axis of the clamping device, at least one of the arms adapted to releasably fasten to a side of an accessory device.

Another object of the invention is to provided a clamping device for coaxially coupling an optical accessory such as a night vision device to a riflescope, the clamping device having a front mounting collar which has a front entrance bore for receiving rearwardly therein a rearwardly projecting ocular barrel of a riflescope, the front mounting collar having a releasable clamping mechanism for clamping the riflescope ocular barrel coaxially within the entrance bore of the collar, and a rear mounting ring which protrudes rearwardly from the collar and has a rear cylindrical entrance bore adapted to coaxially receive therein the front tubular end of an optical accessory device, such as the front objective lens barrel of a night vision device, and a pair of accessory device support arms, which protrude from an outer surface of the rear mounting ring axially rearwardly and parallel to the longitudinal axis of the clamping device, each of the arms having a longitudinally disposed channel adapted to longitudinally slidably receive therein a mounting boss protruding outwardly from the body of the night vision device whereby bosses on opposed sides of the night vision device are slidable longitudinally forwards in inner facing, opposed channels of the pair of opposed support arms, to thereby locate a front tubular end of the night vision device coaxially within a rearwardly facing bore of the rear mounting ring, each arm having a latching lug to engage and releasably hold a night vision device boss within a channel arm.

Another object of the invention is to provide a clamping device for coaxially coupling an optical accessory such as a night vision device to a riflescope, the clamping device having a front mounting collar which has a front entrance bore for receiving rearwardly therein a rearwardly projecting ocular barrel of a riflescope, the front mounting collar having a releasable clamping mechanism for clamping the riflescope ocular barrel coaxially within the entrance bore of the collar, and a rear mounting ring and support arm assembly which is fastened to the front mounting collar by a pivotable joint which enables the rear mounting ring and arm assembly to be pivoted from a releasably latched orientation rearward of and in coaxial alignment with the front mounting collar, to an unlatched orientation in which the assembly is pivotable about a pivot axle attached tangentially to an outer circumferential surface of the front mounting collar, whereby an optical accessary device held coaxially within a rear entrance bore of the rear mounting ring, and supported thereat by an accessory device support arm which protrudes rearwardly from an outer surface of the rear mounting ring and is releasably attached to an outer surface of the night vision device, is latchable into coaxial alignment with a riflescope to which the clamping device is attached, thereby enabling optically coupled usage of the riflescope and accessory optical device, and, upon unlatching a latchable fastener joint joining the rear mounting ring and arm assembly to the front mounting collar, the rear mounting ring, arm, and attached accessary optical device are pivotable away from the front mounting ring and riflescope, thereby enabling direct viewing through the riflescope.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of our exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends clamping devices for releasably coupling a pair of longitudinally arranged optical devices in coaxial alignment with one another. A primary intended use for clamping devices according to the present invention is the temporary coupling of an optical accessary device such as a night vision scope to a telescopic rifle sight or riflescope, with the accessory device located behind and in coaxial alignment with the riflescope. In particular, clamping devices according to the present invention are useful for temporarily coupling a night vision device, such as an infrared image converter or image intensifier, to the eyepiece or ocular end of a riflescope mounted on a rifle, thus enabling the riflescope to be used at night or in other low ambient light-level environments with the night vision device attached by the coupler to the riflescope, and the riflescope quickly and interchangeably restorable to a daylight use configuration by removing the night vision device from coaxial alignment with the riflescope.

According to a main embodiment of the invention, a clamping device for coaxially coupling optical viewing devices to riflescopes includes a cylindrically-shaped front mounting collar which has a front entrance bore adapted to coaxially receive therewithin a tubular rear ocular barrel of a riflescope mounted on the upper side of a rifle barrel. The front mounting collar of the clamping device has a clamping mechanism for securing the clamping device to the ocular barrel of the riflescope, in coaxial alignment therewith. In a preferred embodiment, the clamping mechanism includes means for resiliently decreasing a minimum inner diameter of a generally circular cross-section bore disposed longitudinally through the front mounting collar. In a preferred clamping mechanism for the front mounting collar, the collar has a modified, hollow cylindrical shape, including a solid rear cylindrical base section which is relatively short, and an elastically deformable front section which is relatively longer. The front, elastically deformable portion of the collar is separated from the rear, solid cylindrical portion of the collar by a thin, slot disposed transversely through the cylinder wall, the slot having a circumferential length of about 180 degrees. Thus, front and rear longitudinal portions of the front mounting collar are joined by a thin, generally semi-cylindrically-shaped, longitudinally disposed web located between circumferentially opposed longitudinally disposed edge walls of the slot.

The front elastically deformable portion of the front mounting collar is severed or split into two semi-cylindrically-shaped halves by a longitudinally disposed slot which penetrates the front transversely disposed annular wall and inner and outer cylindrical wall surfaces of the front collar portion, as well as a rear semi-annular wall surface of the front collar and the transverse slot. The front split collar halves of the front mounting collar have protruding radially outwardly therefrom a pair of wedge-shaped clamp arms which have circumferentially opposed, flat, radially and longitudinally disposed edge walls that are coplanar extensions of circumferentially opposed walls of the cylindrical portion of the split collar, and are thus located on opposite sides of the front longitudinal slot.

The clamp arms have disposed transversely and perpendicularly therethrough a pair of opposed bores which insertably receive the shank of a clamp thumbscrew. Tightening the thumbscrew against one clamp arm by turning a shank fixed to the thumbscrew knob within threads within the bores of either or both clamp arm bores, or within an internal threaded bore of a knurled thumbscrew knob, causes a screw head on the opposite end of the shank to be drawn compressively into contact with the outer face of the opposite clamp arm, thus drawing opposed inner longitudinally and radially disposed faces of the clamp arms towards one another. In another arrangement, the thumbscrew knob is internally threaded and tightened on the shank of the screw. Since the opposed clamp arms are integral with opposed split collar halves, tightening the clamp thumbscrew causes the inner cylindrical wall surfaces of the split collar halves to be deformed circumferentially inwards, thus reducing an inner diameter of the split collar bore and thereby causing the semi-cylindrically-shaped split collar halves to exert a radially inwardly directed, compressive clamping force on the outer cylindrical wall surface of a cylindrical object, such as the tubular eye piece tube of a telescopic rifle sight, which has been inserted into the bore with the clamp arms in a loosened, spaced apart arrangement.

Clamping devices according to the present invention also include a rear mounting structure for releasably supporting an optical device such as a night vision device in rigid coaxial alignment with a telescope sight held in the front mounting collar. In preferred embodiments of the invention, the rear mounting structure includes a rear mounting ring which protrudes coaxially and rearwardly from the front mounting collar assembly. The rear mounting ring of the clamping device preferably has a relatively thick cylindrical wall which protrudes rearwardly from the solid, rear base ring portion of the split front collar. The rear mounting ring has a central coaxial bore which extends forward from a rear transverse annular wall of the rear mounting ring, the bore being of an appropriate size to insertably receive the front, objective lens barrel of an optical device such as a night vision device. In one embodiment, front and rear entrance bores of the coupler are separated by a thin, flat transversely disposed, annular ring-shaped diaphragm, which provides front and rear travel limiting surfaces for a riflescope lens barrel and a front objective barrel of night vision devices, respectively.

Rear mounting structures of preferred embodiments of a clamping device for coaxially coupling an optical accessory device such as a night vision device to a riflescope, according to the present invention, use one or a pair of accessory device support arms which extend longitudinally rearwardly of the rear mounting ring. The support arms have releasable fasteners which are attachable to the body of a night vision device, and rigidly hold the device in a fixed position, with the front, objective lens end of the night vision device within the rear entrance bore of the rear mounting ring, and the longitudinally disposed optical axis of the night vision device coaxially aligned with the optical axis of the riflescope.

One embodiment of a rear mounting structure for clamping devices according to the present invention has a pair of parallel, left and right device support arms which are disposed rearwardly from opposite locations of an outer longitudinally disposed portion of the rear mounting ring, e.g., from a pair of circumferentially spaced apart flats of a polygonally-shaped outer longitudinally disposed wall surface of the rear mounting ring. In this embodiment, each of a pair of opposed rearwardly extending accessory device support arms has formed in an inner vertically disposed wall surface thereof a rectangular cross-section channel which extends forward from a rear transverse wall of the arm. This embodiment is adapted to be used with an accessory device such as a night vision device which has front and rear pairs of longitudinally aligned, upper and lower dovetail rail flanges which protrude from upper and lower longitudinal edges of front and rear pairs of square mounting bosses that Protrude from opposite left and right vertical wall surfaces of the night vision device. The channels in the device support arms of the coupler for use with this type of night vision device are provided with upper and lower dovetail grooves of an appropriate size and shape to slidably receive the pairs of mounting boss dovetail rails which protrude from opposite sides of the night vision device.

The above-described clamping device also includes latching means for securing a night vision device from longitudinal movement relative to the rear mounting ring, after the mounting bosses have been slid forward into the device support arm channels. In a preferred embodiment, the latching means includes within each support arm channel, near a rear end thereof, a pivotable spring-biased pawl which has an inwardly projecting end that is biased by a compression spring inwardly towards a vertical center plane of the mounting ring. When the front obliquely rearwardly angled vertical edge wall of a front boss contacts the pawl, the pawl is pivoted resiliently outwardly, allowing the front and rear bosses to move longitudinally forwards sufficiently far for the front transverse edge of the objective lens tube of the night vision device to be seated within the rear mounting ring. When the night vision device is pushed sufficiently far forward for it to be fully installed within the rear mounting ring, the latching pawls spring resiliently inwards into latching engagement with rear straight vertical edges of the front bosses. The pawls are releasable by pressing inwardly on the outer end of a lever arm which protrudes outwardly from a rear end portion of each pawl that protrudes obliquely outwards from an outer rear end of each arm, using a thumb and forefinger, for example, thus pivoting the pawls outwards and enabling the night vision scope to be withdrawn rearwardly from the mounting arm channels and rear mounting ring.

Another embodiment of a clamping device for releasably coupling a pair of optical devices in coaxial alignment, according to the present invention includes a pivot mechanism which enables a rear mounting ring holding a front mounting collar clamped to an auxiliary optical device, such as a night vision scope to be quickly swung away from a riflescope, to enable viewing directly through the riflescope, and swung back into coaxial alignment, when it is desired to use the night vision scope in conjunction with the riflescope.

A preferred embodiment of a "swing-away" clamping device for coaxially coupling together optical viewing devices according to the present invention includes a front clamping assembly that has a split front collar for releasable, long-term attachment to the rear barrel portion of a forward optical device, such as a riflescope. The front clamping assembly also has a solid rear cylindrical base ring section, as described above.

A preferred swing-away clamping device according to the present invention also includes a rear mounting structure for releasably supporting an optical device such as a night vision device, in rigid coaxial alignment with an optical device such as a riflescope clamped within the front clamp assembly. The rear mounting structure includes an elongated optical-device support arm which is connected to the solid rear cylindrical base ring section of the front clamping assembly through a pivot axle assembly. The pivot axle assembly includes a block-shaped pivot axle support boss which protrudes radially outwards from an outer circumferential wall surface of the solid rear cylindrical base ring section of the front clamping assembly. The pivot axle support boss has upper and lower longitudinally disposed wall surfaces which have disposed perpendicularly therethrough a pivot axle bore that is parallel to an inner, tangentially disposed junction between the pivot axle support boss and the outer circumferential wall surface of the rear cylindrical base ring section of the front clamping assembly. A pivot axle disposed through the pivot axle support boss bore has upper and lower protruding ends which extend through aligned upper and lower bores provided through upper and lower, vertically spaced apart forward arm extensions of a bifurcated front block portion of the device support arm. An upwardly offset, doglegged, longitudinally disposed rear portion of the optical device support arm has on an inner vertical wall surface thereof a releasable fastener, such as a dovetail groove or screw, for releasable attachment to a housing of an optical viewing device, such as a night vision device.

The pivot axle within the pivot axle support boss has a first, latched, zero-degree azimuthal angle position in which the optical device support arm is disposed parallel to the longitudinal axis of the front clamping assembly and rearward therefrom, to thereby position a viewing device supported by the arm rearward of and in coaxial alignment with the riflescope. The pivot axle is also rotatable 180 degrees counterclockwise to a second, latched 180-degree azimuthal angle to thereby position the optical device support arm and attached optical device to a forward direction parallel to and along side the riflescope, thus allowing direct viewing through the riflescope.

In a preferred embodiment of a swing-away clamping device according to the present invention, the pivot axle latching mechanism includes a latch-release push button axially slidably mounted over an end of the pivot axle protruding outwards from an outer surface of an arm extension. The push button has a pair of fixed axially inwardly disposed pins located on opposite sides of the axle, which are aligned with a pair of spring-loaded boss pins. The spring-loaded pins are biased outwards within bores in the boss and into through-bores within the arm extension, thus preventing rotation of the axle and attached arm with the arm in a first, zero-degree latched position. When the push button is depressed, junctions between contacting transverse ends of push button pins and spring-loaded boss pins become aligned with parallel, longitudinally disposed mating faces of the arm extension and boss, thus enabling the arm to rotate to a second, 180-degree latched position with respect to the boss. The push button is biased to an outward, latched position by an internal helical compression spring coaxially centrally located within a coaxial central bore disposed through the axle. The spring exerts an axially outwardly directed force on a cylinder located within the axle bore, the cylinder having a smaller diameter concentric shaft extension which protrudes axially from an outer transverse face of the cylinder and through a bore through an outer end of the axle, an outer end of the shaft being fastened concentrically to an inner transverse face of the push button. A preferred embodiment of a two-position, swing-away coupler according to the present invention includes a torsion spring connected between the pivot axle support boss and the support arm. The torsion spring exerts a resilient torque between the boss and arm so that the arm springs forward to a 180-degree latched position when the latch release push button is depressed.

In an alternate construction, the push button is mounted coaxially over an outer extension of the pivot axle, and is biased outwards by an internal helical compression spring mounted coaxially over the pivot axle extension and disposed between inner facing surfaces of the push button and an adjacent arm extension.

DESCRIPTION OF THE PREFERRED EMBODIMENTS

Figure 28:
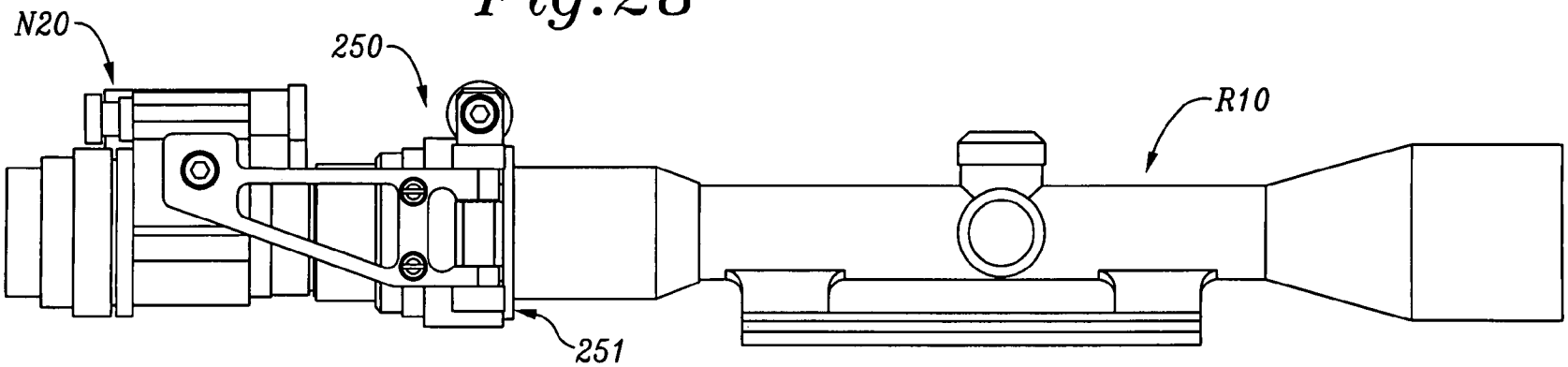
FIG. 28 is a right side elevation view of the arrangement of FIG. 27.
Figure 29:
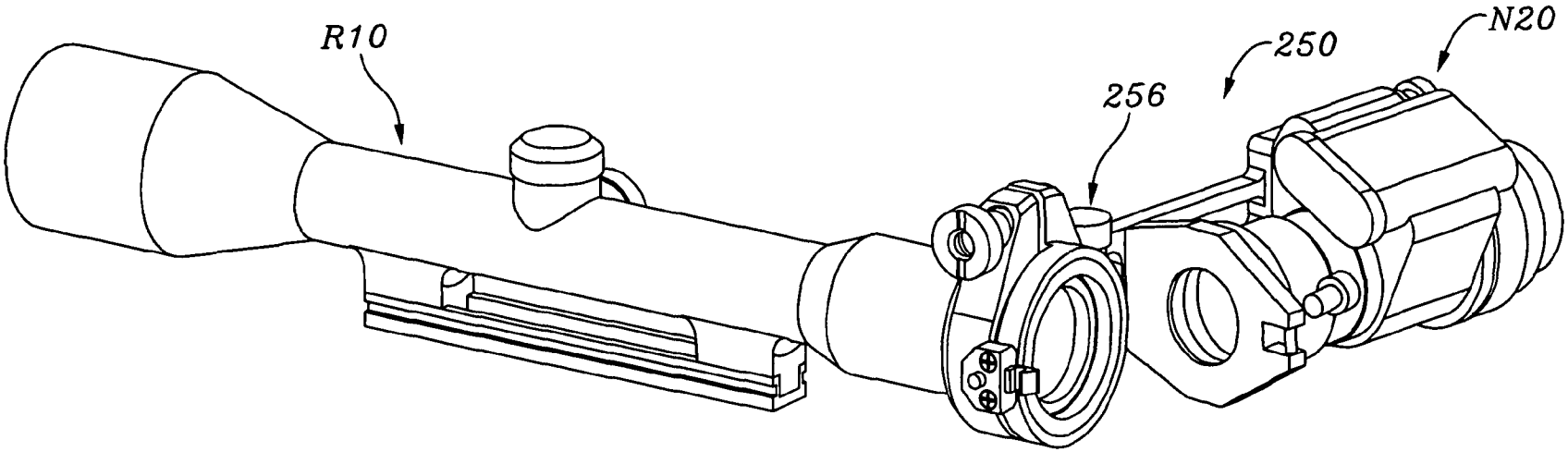
FIG. 29 is a view similar to that of FIG. 28, but showing a mounting arm of the coupler released from a telescopic clamp portion of the coupler and pivoted along with a night vision device attached to the arm away from a riflescope to enable viewing directly through the riflescope.
Figure 30:
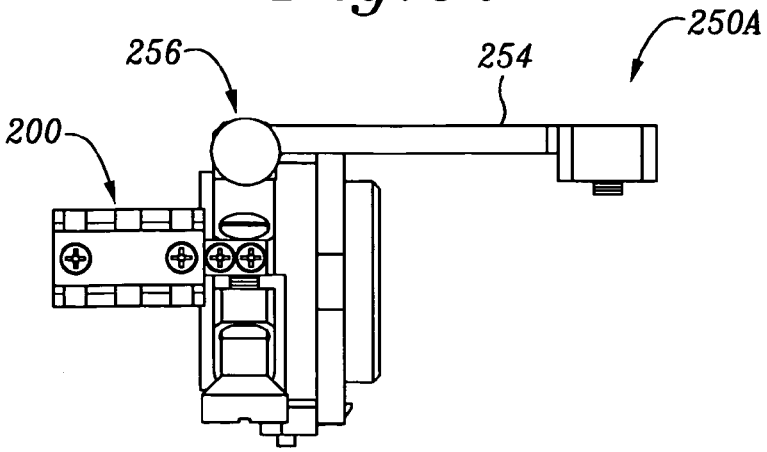
FIG. 30 is an upper plan view of a modification of the coupler of FIG. 18
Figure 31:
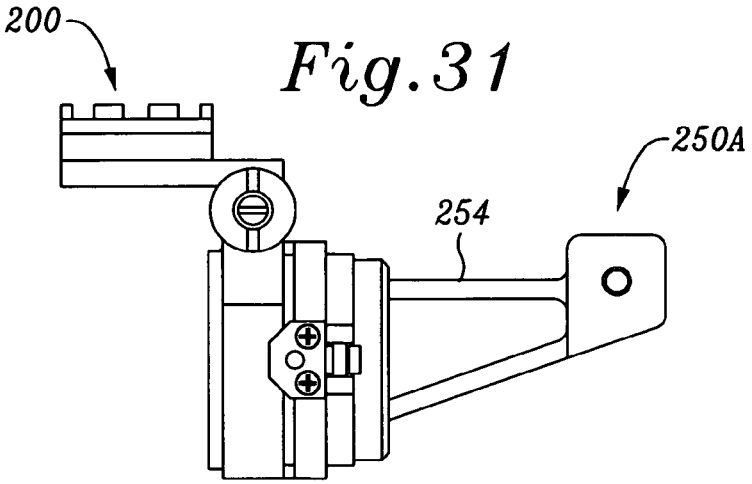
FIG. 31 is a left side elevation view of the coupler of FIG. 30.
Figure 32:
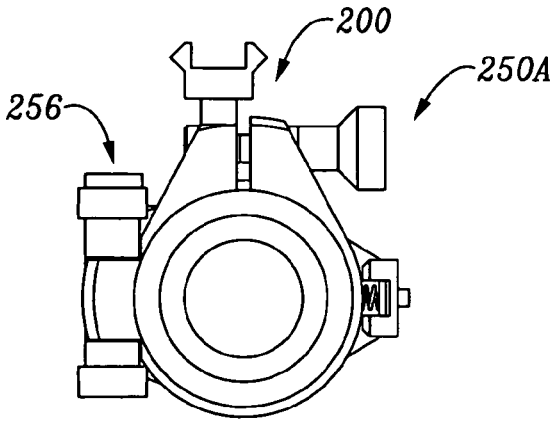
FIG. 32 is a front elevation view of the coupler of FIG. 30.

FIGS. 1-17 illustrate a basic, double-arm embodiment of a clamping device for coaxially coupling optical viewing devices to riflescopes, according to the present invention. FIGS. 18-29 illustrate a single-arm, swing-away embodiment of the invention. FIGS. 30-32 illustrate a modification of the swing-away embodiment of the invention.

Referring first to FIGS. 1-7, a basic embodiment 50 of a clamping device or coupler for coaxially coupling optical devices to riflescopes according to the present invention may be seen to include a split front mounting collar 51 which is adapted to coaxially receive the rear, ocular or eyepiece tube of a riflescope, and a front clamp assembly 52A which secures the eyepiece tube within a split collar 61. Coupler 50 also includes a rear tubular mounting ring 53 which protrudes rearwardly from and is coaxially aligned with front mounting collar 51 and front clamp assembly 52A. Rear tubular mounting ring 53 is adapted to coaxially receive the tubular front objective lens end of a night vision device. Coupler 50 also includes a pair of laterally-spaced apart, parallel, left and right mounting arms 54L, 54R, which protrude rearwardly from longitudinally disposed outer peripheral surfaces 56, 57 of rear tubular mounting ring 53. Mounting arms 54 are adapted to releasably secure therebetween a central barrel section of a night vision device, such as night vision device A shown in FIG. 8.

As shown in FIGS. 1-7, front mounting collar 51 of coupler 50 has a rear, inner cylindrical ring-shaped base section 58. Base section 58 has a rear annular ring-shaped transverse face 59 which abuts or is coextensive with a front annular ring-shaped transverse face 60 of rear tubular mounting ring 53. Front mounting collar 51 also has a front, split cylindrical ring-shaped section 61 which has inner and outer longitudinally disposed, generally circular cylindrically-shaped walls 62, 63 that are coextensive with inner and outer cylindrical walls 64, 65 of rear cylindrically-shaped base section 58.

As may be seen best by FIGS. 1, 4A, 5, 6, 7A and 7B, front, split ring-shaped section 61 of front mounting collar 51 is partially separated longitudinally from rear, inner cylindrical ring-shaped base section 58 of the front mounting collar by a thin, transversely disposed slot 66 which penetrates inner and outer cylindrical walls of both the front and rear portions of the front mounting collar. Transverse slot 66 has a circumferential length of about 180 degrees, centered on a longitudinally disposed plane which is offset about 10 degrees from a horizontal longitudinal plane disposed through the front mounting collar.

As shown in FIGS. 1, 5, 6, 7, 22A and 23, split ring-shaped section 61 of front mounting collar 52 is split into two generally semi-cylindrically-shaped halves by a longitudinally disposed slot 68 which extends longitudinally rearwards from the front annular wall 69 of the front split ring-shaped section, a longitudinally inwardly located end of the longitudinal slot penetrating rear transverse slot 66. Thus, as shown in FIGS. 3, 4A, 4B, 7, 7A and 7B, split ring-shaped section 61 of front mounting collar 52 is split by slot 68, located in a radially disposed vertical cutting plane into left and right halves 70, 71, respectively.

As shown in FIGS. 2-7B, front mounting collar 52 includes a pair of laterally opposed left and right clamping arms 72, 73 which protrude transversely outwards from outer circumferential surfaces 74, 75 of left and right split collar halves 70, 71, respectively. As may be seen best by referring to FIGS. 2, 3, 4A, 4B and 5, clamping arms 72, 73 have the shape of uniform longitudinal thickness wedges. Thus, left clamping arm 72 has a flat, transversely disposed front wall 76 which is coplanar with front transverse end wall 77 of left split collar half 70, a rear transversely disposed wall 78 parallel to the front transverse wall, an inner flat, longitudinally and radially disposed flat clamp wall 79, a radially outwardly located longitudinally disposed curved convex outer wall 80, and an oblique outer straight longitudinally disposed wall 81 which angles obliquely outwards from outer circumferential wall surface 74 of left collar half 70. Similarly, right clamping arm 73 has a front transversely disposed front 86 which is coplanar with front transverse end wall 87 of right split collar half 75, a parallel rear transverse wall 88, a longitudinally and radially disposed flat clamp wall 89, a convexly curved outer wall 90, and a straight oblique wall 91.

Figure 4A:
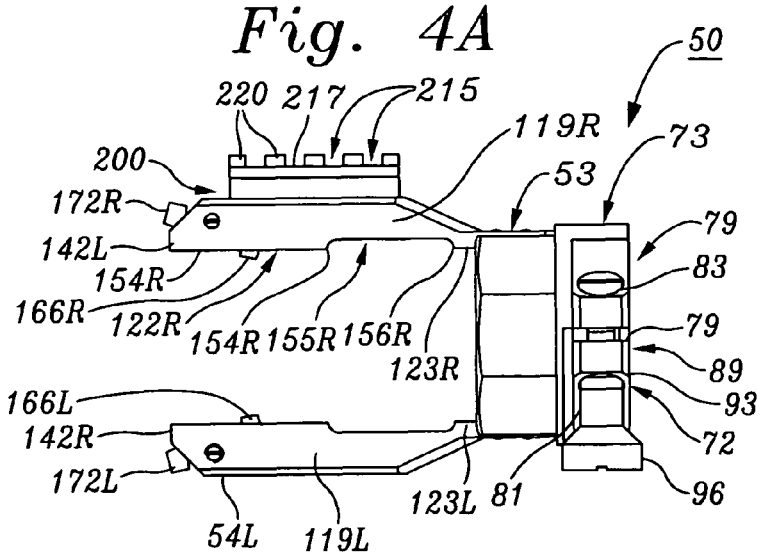
FIG. 4A is a lower plan view of the coupler of FIG. 1.
Figure 4B:
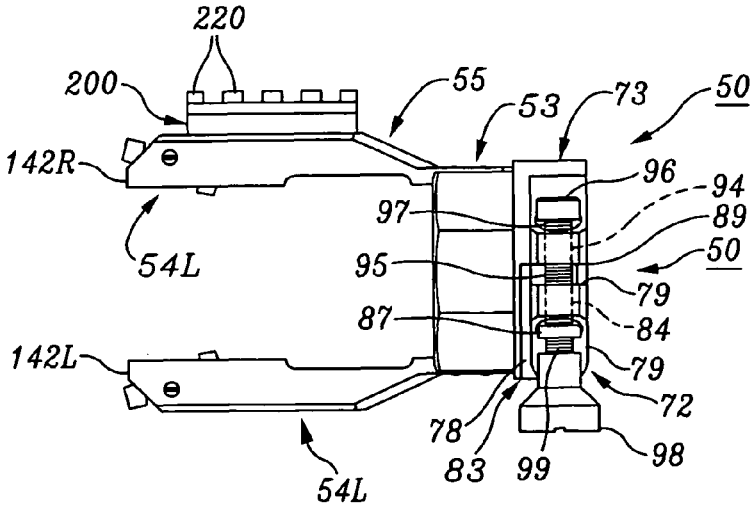
FIG. 4B is a view similar to that of FIG. 4A, but showing a clamp assembly of the coupler loosened.
Figure 5:
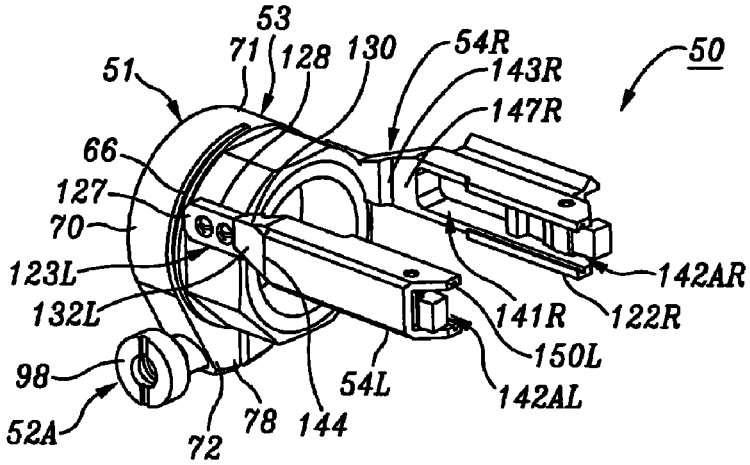
FIG. 5 is a rear perspective view of the coupler of FIG. 1.
Figure 6:
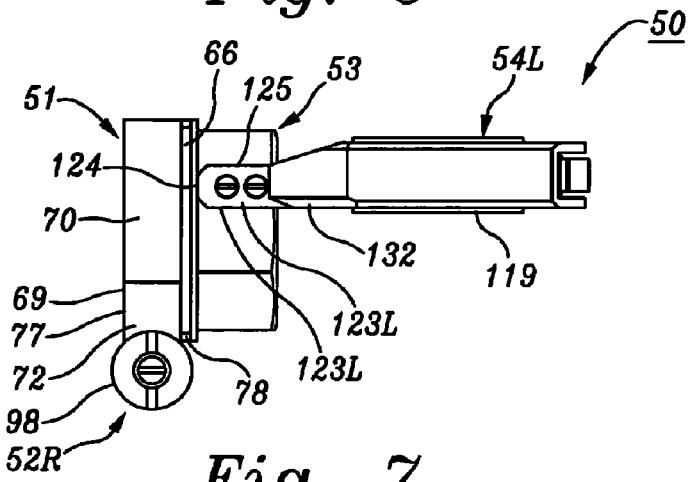
FIG. 6 is a left side elevation view of the coupler of FIG. 1.

As may be seen best by referring to FIGS. 4A, 4B, and 5, outer oblique wall 81 of left-hand clamp arm 72 has cut inwardly therein a wedge-shaped notch 82 which has a flat, radially disposed flat outer compression wall 83 that is located transversely outwardly of and parallel to inner flat clamp wall 79 of the left clamp arm. A fastener bolt hole 84 is disposed perpendicularly through outer flat compression wall 83 and inner, flat inner clamp wall 79 of left-hand clamp arm 72.

Similarly, outer oblique wall 91 of right-hand clamp arm 73 has therein a wedge-shaped notch 92 which has a flat, radially disposed flat outer compression wall 93 that is located transversely outwardly of and parallel to flat inner clamp wall 89 of the right-hand clamp arm. A fastener bolt hole 94 is disposed perpendicularly through outer flat compression wall 93 and inner flat clamp wall 89.

Figure 8:
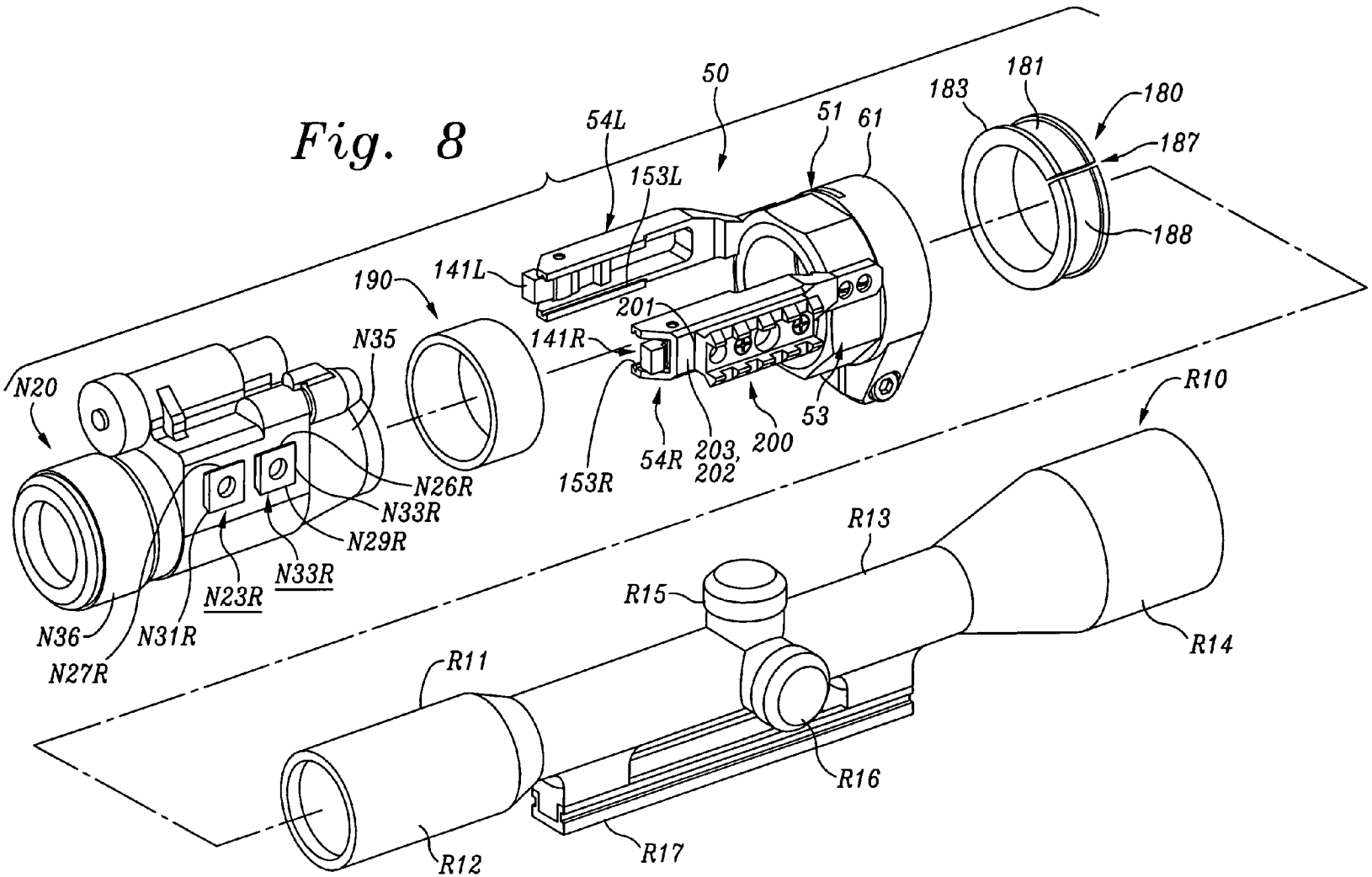
FIG. 8 is a right side perspective view of the coupler of FIG. 1, showing the coupler and an adapter bushing thereof positioned between a riflescope and a night vision device preparatory to using the coupler to join the riflescope to the night vision device.
Figure 9:
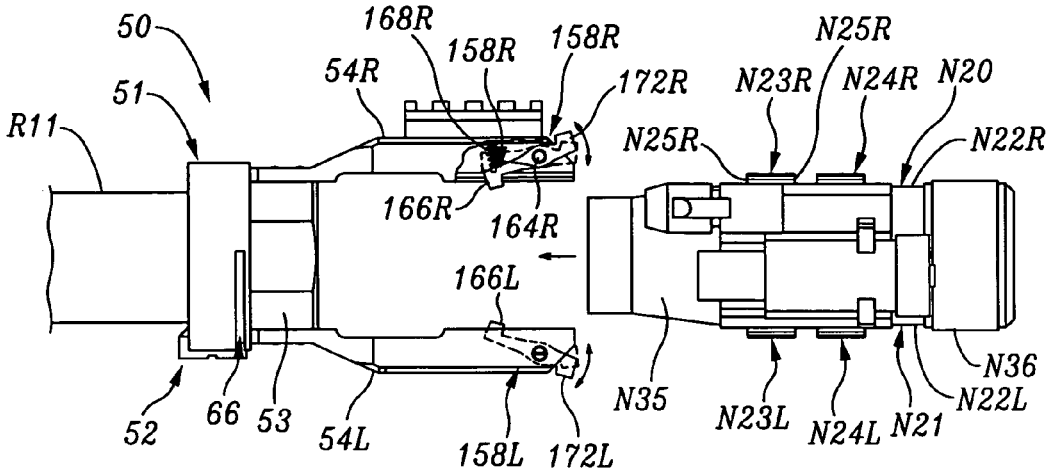
FIG. 9 is a fragmentary, partly broken away upper plan view of the elements of FIG. 8, showing the coupler clamped to the riflescope, and a night vision device in position to be inserted forward into the coupler.
Figure 10:
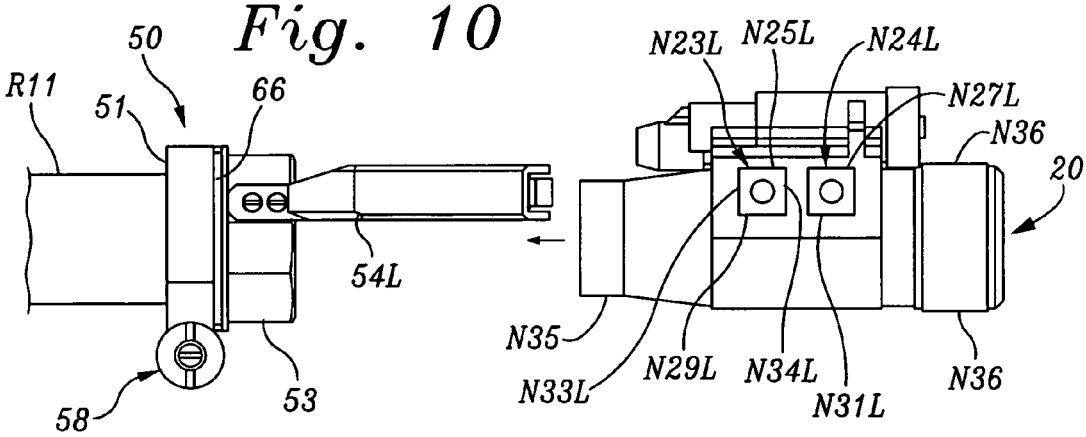
FIG. 10 is a left side elevation view of the arrangement of FIG. 9.
Figure 11:
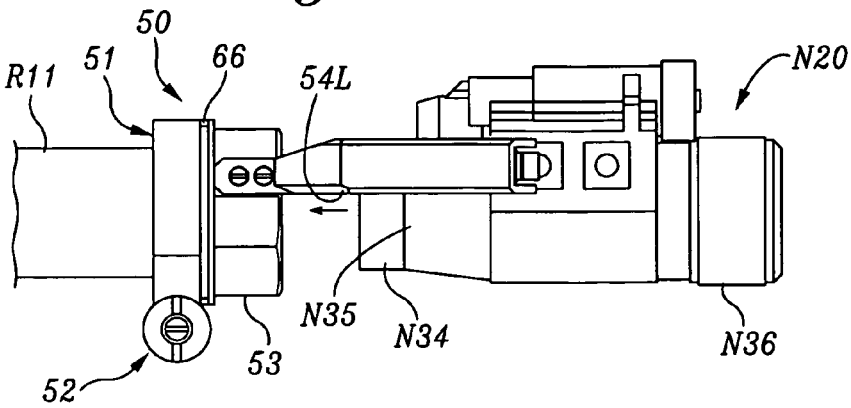
FIG. 11 is a view similar to that of FIG. 10, showing the coupler partially inserted into the coupler.
Figure 12:
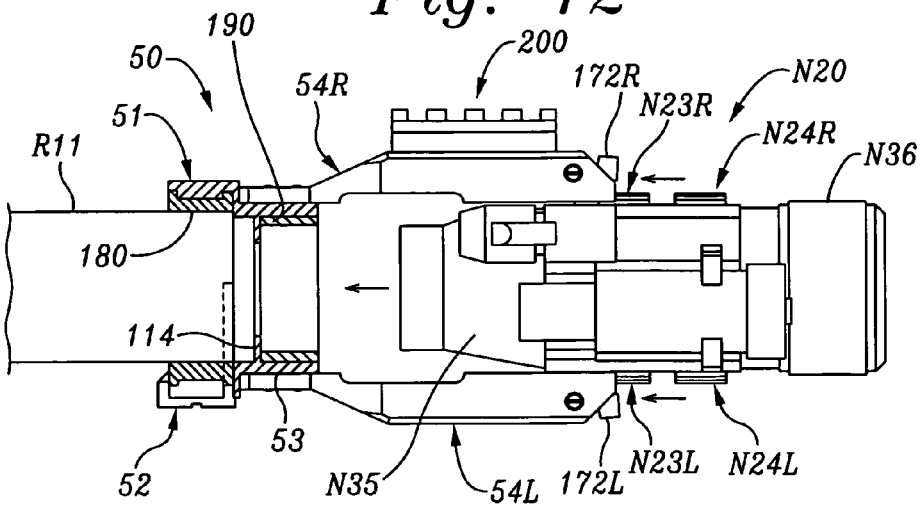
FIG. 12 is an upper plan view of the arrangement of FIG. 11.
Figure 13:
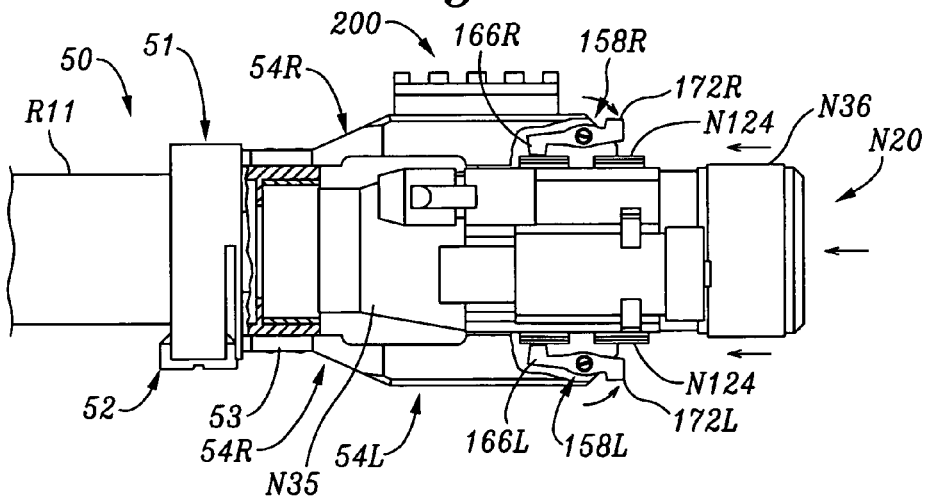
FIG. 13 is a partly broke-away view similar to that of FIG. 12, but showing the night vision device inserted approximately halfway into the coupler.
Figure 14:
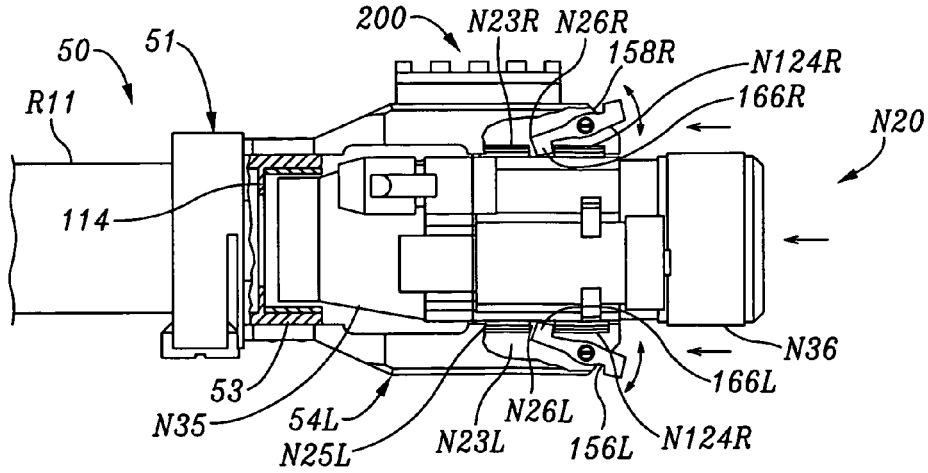
FIG. 14 is a view similar to that of FIG. 13, showing the night vision device inserted fully into the coupler.
Figure 15:
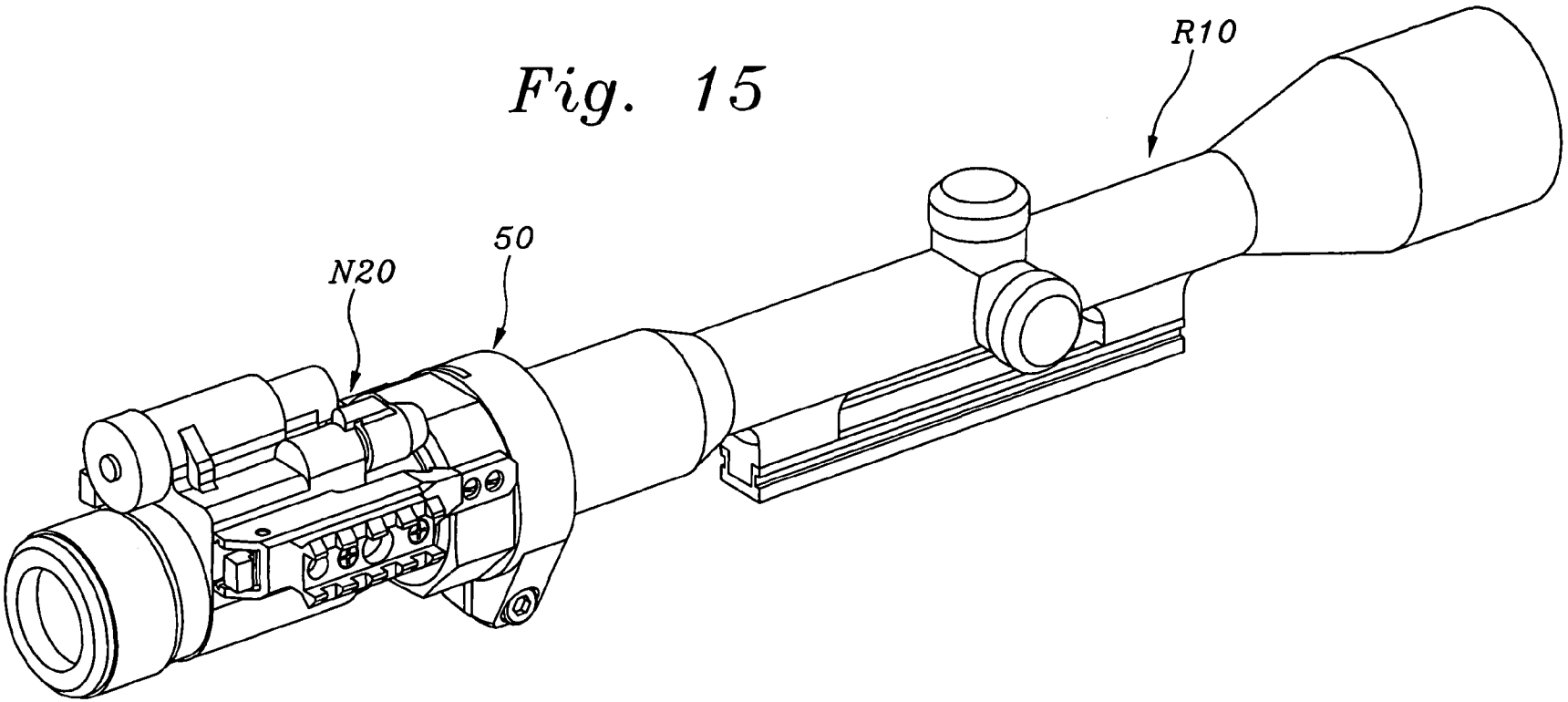
FIG. 15 is a view similar to that of FIG. 8, but showing the elements of FIG. 8 installed and coupled together.

As may be seen best by referring to FIGS. 4A and 4B, clamp fastener holes 84 and 94 are coaxially aligned, and receive therethrough a threaded screw 95 which has a slotted head 96 and an elongated threaded shank 97, which is threadably received within a threaded internal bore 99 of a thumb knob 98. Preferably, a friction-limiting bushing 100 is fitted over shank 97 of screw 95, between thumb knob 98 and an outer clamp leg slot, such as outer slot 93. Thus constructed, screw 95 may be tightened from the position shown in FIG. 4B to the position shown in FIG. 4A. Tightening screw 95 draws inner clamp walls 79, 89 together, and split collar halves 70, 71 of front mounting collar 52 to be drawn towards one another, thus decreasing the diameter of the entrance bore 100 of the mounting collar, and thus clamping the collar halves to the outer cylindrical wall surface of a cylindrical object inserted into the bore, such as the outer cylindrical surface R12 of the rear, ocular tube R11 of a riflescope R10, as shown in FIGS. 8 and 15.

As shown in FIGS. 1-7B and 9, clamping device 50 for coaxially coupling optical devices to riflescopes according to the present invention includes a rear mounting structure 101 for holding an optical device such as a night vision scope in rigid coaxial alignment with a riflescope R10 clamped in front mounting collar 51. As shown in those figures, the embodiment 50 of a clamping device according to the present invention includes a rear tubular mounting ring 102 which has a central longitudinally disposed coaxial rear bore 103 that is axially aligned with and continuous with front entrance bore 100 of front mounting collar 51.

As may be seen best by referring to FIGS. 1-3 and 5, rear tubular mounting ring 102 has a longitudinally disposed, circular cross-section circumferential inner wall 104. The cross-sectional shape of outer circumferential wall 105 is not critical. However, for the embodiment 50 of a clamping device according to the present invention, outer circumferential wall 105 has a generally polygonal shape. Thus, as shown in FIGS. 1-3 and 5, outer circumferential wall 105 has a generally hexagonal transverse cross-sectional shape, comprised of flat, longitudinally disposed upper, lower, upper left, upper right and lower left, lower right faces 106, 107, 108, 109, 110 and 111, respectively.

Figure 7:
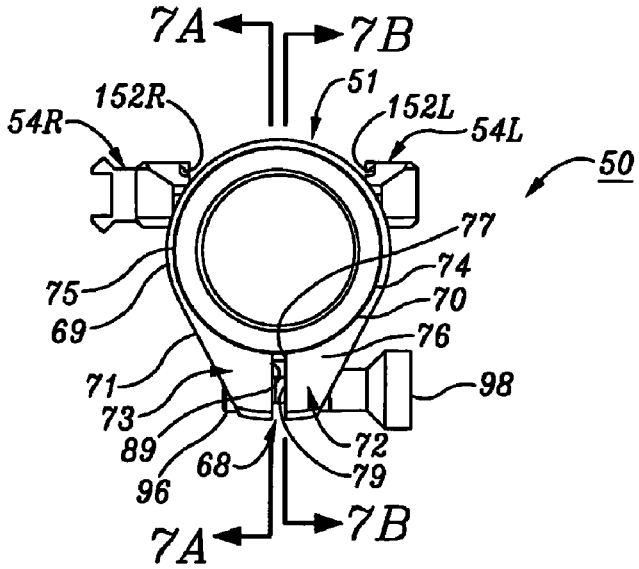
FIG. 7 is a front elevation view of the coupler of FIG. 1.
Figure 7A:
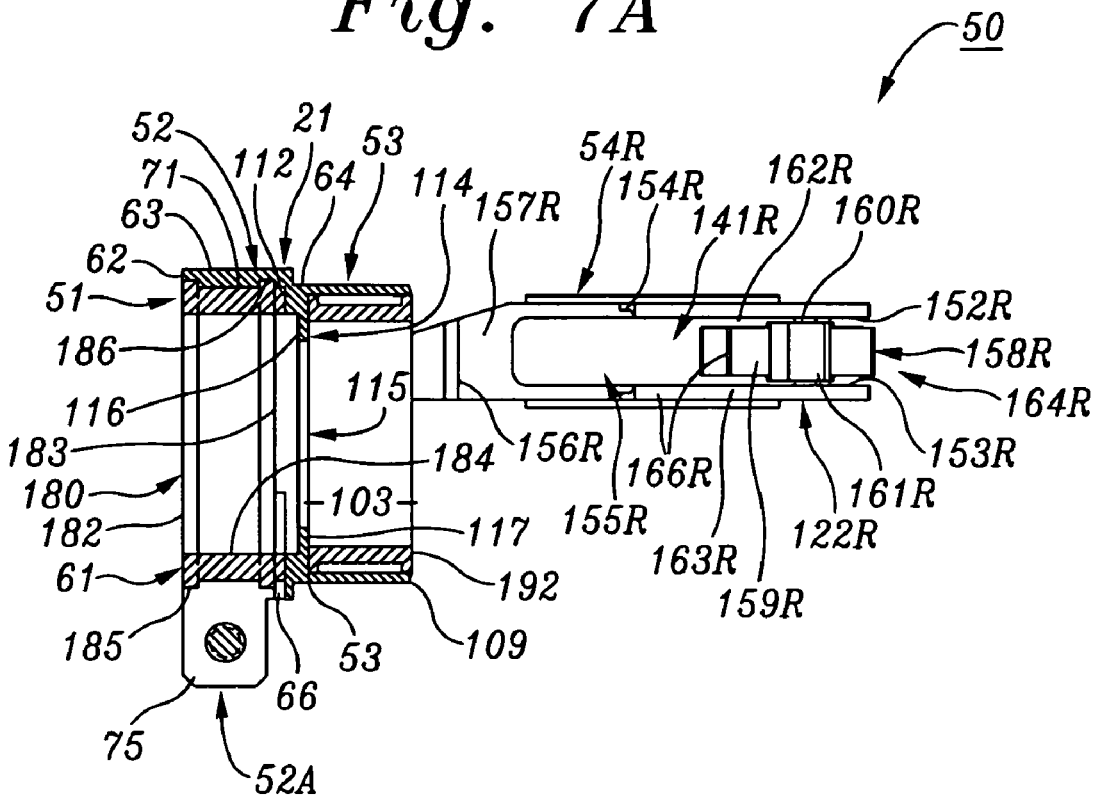
FIG. 7A is a vertical medial sectional view of the coupler of FIG. 7, taken in the direction of lien 7A-7A.

As shown in FIG. 7A, rear tubular mounting ring 102 has a generally hexagonally-shaped transversely disposed front surface 112 which is continuous with circular rear face 113 of rear cylindrical base section 58 of front mounting collar 52. As may be seen best by referring to FIGS. 3, 7 and 7A, tubular rear mounting ring 102 has located coaxially within bore 103 thereof, a thin, transversely disposed annular ring-shaped flange plate or diaphragm 114 which protrudes radially inwardly from inner cylindrical wall surface 104. Diaphragm 114 is located a short distance rearward of front transverse face 112 of rear mounting ring 102, and has disposed longitudinally through its thickness dimension a coaxial hole 115 which is slightly smaller in diameter than bore 103 through the rear mounting ring. Front and rear annular faces 116, 117, respectively of diaphragm 114 limit rearward movement of a telescopic sight eyepiece barrel and forward movement of the objective barrel of an accessory optical device, respectively.

Referring to FIGS. 1-6, it may be seen that rear mounting structure 101 of clamping device 50 includes a pair of parallel left and right accessory support arms 54L, 54R which are disposed rearwardly from rear mounting ring 102. Each arm, e.g., left arm 54L, has a longitudinally elongated, generally rectangular cross-section shape including a flat, longitudinally disposed, lower base wall 119, a parallel longitudinal disposed upper wall 120, an outer longitudinally disposed vertical wall 121, and an inner vertical longitudinally disposed wall 122. Each accessory device support arm 54 includes a longitudinally elongated, rectangular bar-shaped front mounting bracket 123 which has a front transversely disposed vertical edge wall, 124 upper and lower parallel, longitudinally disposed walls 125, 126, and outer and inner parallel longitudinally disposed vertical walls 127, 128. Inner vertical edge wall 128 is coplanar with inner vertical surface 122 of support arm 54.

Figure 1:
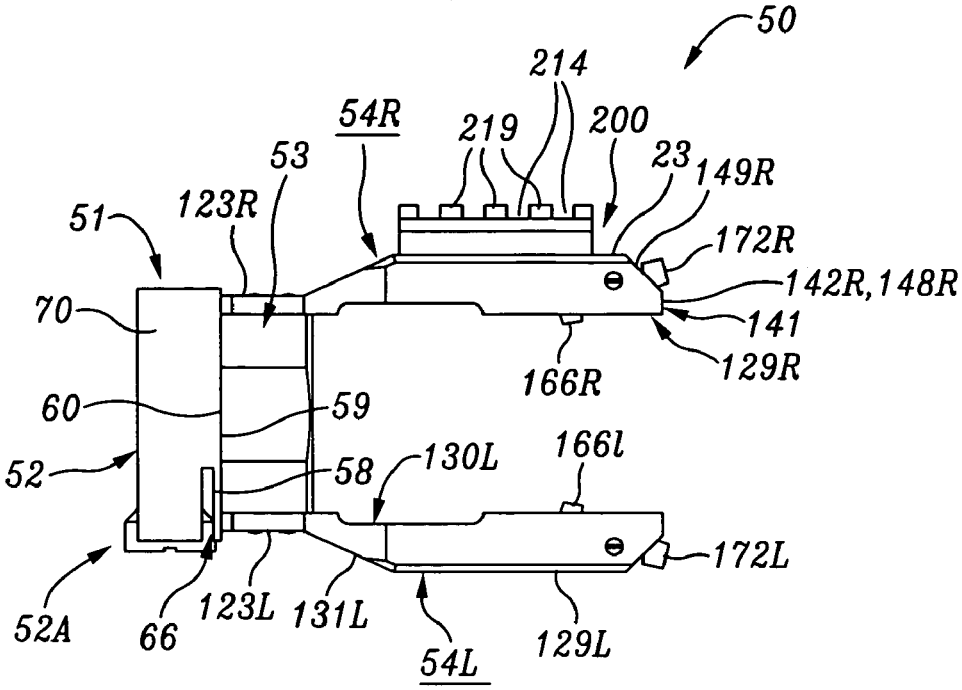
FIG. 1 is an upper plan view of a double-arm embodiment of a releasable coaxial optical coupler according to the present invention.
Figure 2:
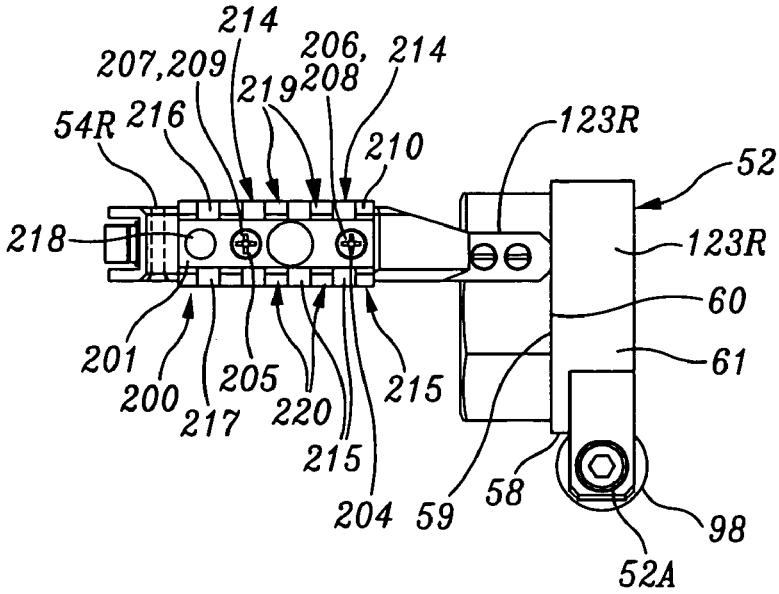
FIG. 2 is a right side elevation view of the coupler of FIG. 1.
Figure 3:
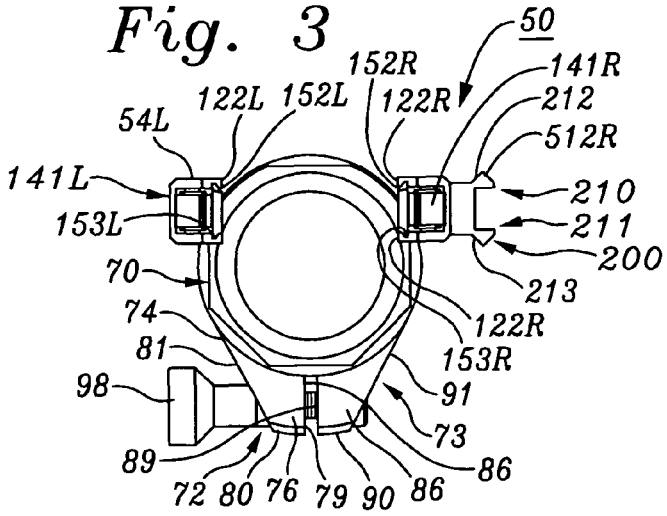
FIG. 3 is a rear elevation view of the coupler of FIG. 1.

As shown in FIGS. 1 and 2, each support arm 54 has a relatively long rear portion 129 which is substantially longer than front mounting bracket 123, and is joined thereto by a short, trapezoidally-shaped transition section 130 which angles obliquely outwards from the bracket to the long rear portion. Transition section 130 has a flat, trapezoidally-shaped outer wall 131 which has a bottom wall surface 132 that is continuous with bottom wall surfaces 119 and 126 of rear arm 54 and front bracket 123.

As may be seen best by referring to FIG. 1, outer wall 131 of transition section 130 angles obliquely inwards from outer vertical wall surface 121 of arm 54 to join outer vertical wall surface 127 of mounting bracket 123. Also, as may be seen best by referring to FIG. 2, transition section 130 has an upper wall 133 which angles obliquely downwards from upper wall 120 of support arm 54, to outer vertical wall surface 127 of front mounting bracket 123 and is joined thereto. As shown in FIGS. 1-3 and 5, inner flat wall surface 128 of mounting brackets 123L, 123R seat on vertically disposed flats 134L, 134R cut in upper left and upper right, outer polygon walls 108 or 109, respectively. Bracket 123 is secured to flat 134 by a pair of front and rear screws 135, 136 mounted through fore-and-aft clearance holes 137, 138 through the bracket, and tightened into aligned threaded blind bores 139, 140 in flat 134

Referring to FIGS. 1, 3, 5 and 9, it may be seen that each accessory device support arm 54 has formed in inner longitudinally disposed, vertical wall surface 122 thereof a rectangular cross-section channel 141. As shown in FIGS. 1, 5, 7A, channel 141 in each arm 54 is disposed longitudinally forward from a rear vertical wall 142 of the arm, to a front vertically and transversely disposed end wall 143 located near a vertical joint line 144 between longitudinally disposed outer wall 121 of the arm and outer wall 130A of transition section 130. Thus constructed, channel 141 has flat, parallel, longitudinally disposed horizontal upper and lower walls 145, 146 in addition to front vertical end wall 143. Each channel also has a longitudinally disposed, flat, vertical outer base wall 147 which has a longitudinally elongated, rectangular shape. As shown in the figures, channel 141 penetrates a rear vertical wall 142 of arm 54 to form a rectangular cross-section entrance opening 142A. Also, rear wall 142 of arm 54 has a transversely disposed vertical rear portion 148, which is disposed perpendicularly to upper and lower longitudinal walls 120, 119 of arm 54 and an oblique vertical portion 149 which is angled obliquely forwards from a vertically disposed, laterally outwardly located edge 150 of the transverse rear vertical portion 148, the oblique edge wall intersecting outer vertical wall 124 of the arm.

As may be seen best by referring to FIGS. 3, 5, 7A and 7B, opposed inner facing, longitudinally disposed upper and lower walls 145, 146 of each channel 141 have formed therein thin, longitudinally disposed upper and lower dovetail grooves 152, 153, respectively. Grooves 152, 153 have a uniform V-shaped or wedge-shaped transverse cross-section which are adapted to slidably receive complementary-shaped dovetail flanges which protrude from left and right sides N22L, N22R of the body N21 of a night vision scope N20. The flanges protrude from left and right pairs of front and rear longitudinally aligned, rectangular bosses N23L, N23R, N24L, N24R, respectively. These flanges comprise left and right front upper flanges N25L, N25R which protrude vertically upwardly from upper edges N26L, N26R of front bosses N23L, N23R, left and right upper rear flanges N27L, N27R which protrude upwards from upper edges N28L, N28R of rear bosses N24L, N24R and are longitudinally aligned with the front flanges. The flanges also include lower front flanges N29L, N29R which protrude downwardly from lower edges N30L, N30R of front bosses N23L, N23R, and lower rear flanges N31L, N31R which protrude downwards from lower edges N32L, N32R of rear bosses N24L, N24R, and are longitudinally aligned with the front flanges.

Upper and lower dovetail grooves 152, 153 are located a short distance outwards from inner vertical wall 122 of each support arm 54, and penetrate rear vertical wall surface 142 of each arm. As shown in the figures, forward ends of grooves 152, 153 penetrate a rear vertically disposed, arcuately curved edge wall 154 of a generally rectangular plan-view, longitudinally elongated notch 155 cut outwardly into inner vertical wall surface 122 of arm 54. Notch 155 also has a front, vertically disposed arcuately curved end wall 156 which is located a short distance rearwards of front mounting bracket 123. Front and rear vertical notch end walls 156, 154 are shaped symmetrically to one another, and join at outer lateral edges thereof to an elongated, flat, longitudinally disposed vertical floor or base wall 157. The purpose of notches 155L, 155R in arms 54L, 54R is to provide finger access to the rotatable objective lens of night vision device mounted between the arms, thereby allowing the device to be focused when optically coupled to a riflescope.

As may be seen best by referring to FIGS. 5, 7A, 7B and 9, each support arm 54 has pivotably mounted within channel 141 thereof a latching pawl 158. As shown in the figures, each pawl 158 includes a longitudinally elongated rectangular bar-shaped arm 159, and upper and lower rectangularly-shaped pivot bosses 160, 161 which protrude upward and downward, respectively, from upper and lower longitudinal surfaces 162, 163 of the arm. Pawl 158 is pivotably mounted within a channel 141, near rear entrance opening 164 of the channel, by a vertically disposed pivot pin or axle 165 which penetrates upper and lower walls 145 and 146 of the channel. Each pawl 158 has a uniform vertical cross-section, wedge-shaped hook 166 which protrudes perpendicularly inwards from a front vertical edge wall 167 of the pawl arm 159. Hook 166 is urged resiliently inwards, to protrude slightly beyond inner vertical edge wall 122 of channel 141, by a compression spring 168 located in blind bores 169, 170, respectively, in base wall 147 of the channel, and in a facing surface 171 of the hook.

Each pawl 158 also has at a rear longitudinal end thereof of rectangular bar-shaped finger lever 172. As may be understood by referring to FIG. 9, when an inwardly directed compressive force is exerted on finger levers 172L, 172R, as by the thumb and forefinger of a person's hand, the radially inwardly projecting hooks 166L, 166R will be withdrawn inwardly of dovetail grooves 152L, 152R, 153L, 153R and channels 141L, 141R. This construction enables a night vision device or other optical device which has dovetail mounting bosses to be longitudinally slidably mounted in arms 54 by first inserting the front bosses of the device into channels 141L, 141R of left and right arms 54L, 54R, as shown in FIGS. 9-14. The device is then pushed forward within the channels sufficiently far for obliquely rearwardly angled, front vertical edges N33L, N33R of the front bosses to contact hooks 166 and resiliently pivot them inwardly into channels 141. With upper and lower dovetail flanges of the bosses slidably engaged within upper and lower dovetail grooves 152, 153, in the upper and lower channel walls, the device is then pushed forward into the channels sufficiently far for hooks 166L, 166R to spring resiliently behind rear vertical edges N34L, N34R of the front bosses. To remove night vision device N20 from coupler 50, the pawl hooks 166 are pivoted inwardly into channels 141 by applying a compressive force on finger levers 172L, 172R as described above. The night vision device can then be grasped in the person's other hand and slid rearward from the coupler to remove the device.

FIGS. 8-14 illustrate use of clamping device 50 according to the present invention to coaxially couple an accessory optical device, i.e., a night vision scope to a riflescope.

Referring first to FIG. 8, clamping device 50 is shown positioned between a riflescope R10 and night vision scope N20, preparatory to releasably mounting the night vision scope to the riflescope. Riflescope R10 is of conventional design including a main tube R13, front objective tube R14, rear ocular tube R11, mounting rail R17, elevation adjusting knob R15 and windage adjusting knob R16.

Night vision scope N20 is also of conventional design, including an elongated front tubular body N21, objective lens focus adjustment ring N35, and rear ocular tube N36. Night vision device 20 also has protruding outwardly from opposite left and right lateral sides thereof pairs of front and rear longitudinally aligned pairs of left and right square cross-section mounting bosses, including front mounting bosses N23L, N23R and rear mounting bosses N24L, N24R. Each boss has protruding upwardly and downwardly, respectively, of upper and lower edges thereof a longitudinally disposed dovetail flange which has a wedge-shaped transverse cross-section, including left and right upper flanges N25L, N25R, left and right front lower flanges N29L, N29R, left and right rear upper flanges N27L, N27R, and left and right rear lower flanges N31L, N31R.

As shown in FIG. 8, clamping device 50 optionally utilizes a bore-size adjustment bushing 180 to enable front mounting collar 52 to snugly receive within bore 100 of the collar riflescope ocular tubes B of smaller diameter than the minimum clamped diameter of the mounting collar bore. Preferably, bushings 180 are provided in a variety of thicknesses to enable clamping device 50 to be securely clamped onto ocular tubes of various sizes.

Figure 7B:
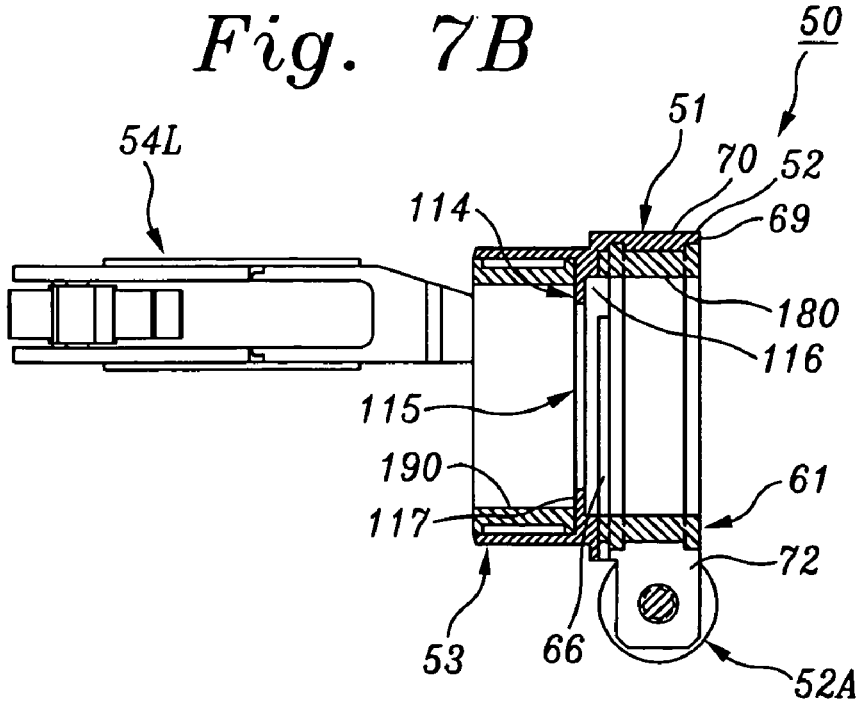
FIG. 7B is another vertical medial sectional view of the coupler of FIG. 7, taken in the direction of line 7B-7B.

Preferably, bushing 180 is made of a relatively rigid plastic material such as nylon, and has the shape of a cylindrical ring 181 which has front and rear radially outwardly projecting annular ring-shaped flanges 182, 183, respectively. As shown in FIG. 8, bushing 180 is preferably split into semi-cylindrically-shaped halves by a longitudinally and radially disposed cut 180A. With this construction, as shown in FIGS. 7A and 7B, the inner cylindrical wall surface 184 of split front cylindrical ring-shaped section 61 of front mounting collar 52 has formed therein, adjacent to front annular wall surface 69 of the split collar, an annular ring-shaped groove 185 of suitable diameter, and depth and longitudinal thickness to conformally receive front flange 182 of bushing 180.

Similarly, inner cylindrical wall surface 184 of split front mounting collar 52 has formed near a rear, inner end thereof a rear annular ring-shaped groove 186 of suitable diameter, depth and longitudinal thickness to conformally receive rear flange 183 of bushing 180. As shown in FIG. 5, cylindrical bushing 180 is preferably split into two connected semi-cylindrically-shaped halves by a thin, longitudinally and radially disposed out 187 through cylindrical wall 188 of the bushing. Optionally a cylindrical flange-less elastomeric bore-size adjustment bushing (not shown) may be substituted for flanged bushing 180, in which case, front mounting collar 52 does not require flange retention grooves 185, 186.

As shown in FIG. 8, clamping device optionally utilizes a rear bushing 190 made of a resilient material such as a natural or synthetic elastomer, which fits concentrically between objective lens barrel N36 of night vision device N20, and inner cylindrical wall surface 191 of rear mounting ring 53.

Figure 16:
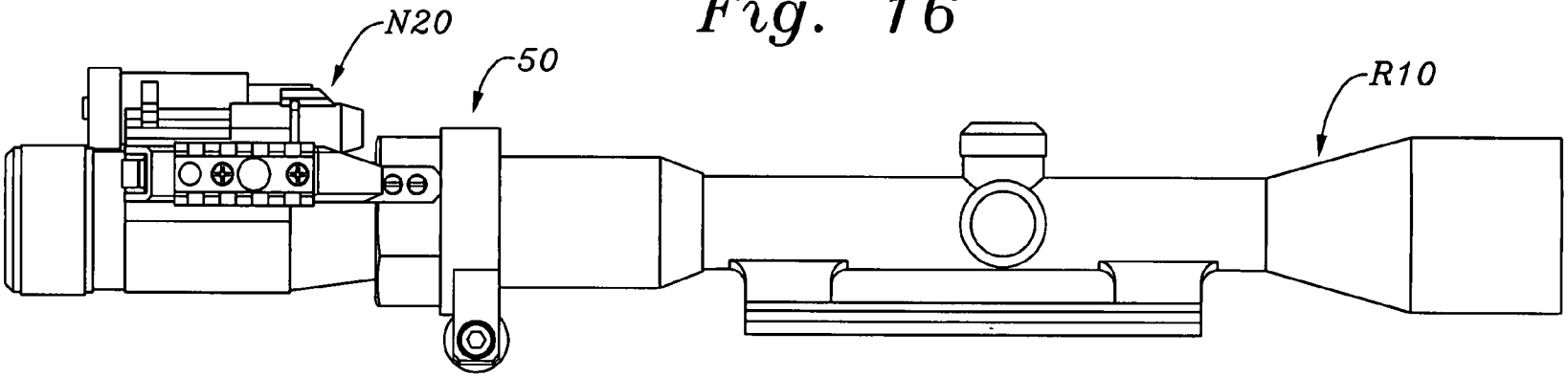
FIG. 16 is a right-side elevation view of the arrangement of FIG. 15.
Figure 17:
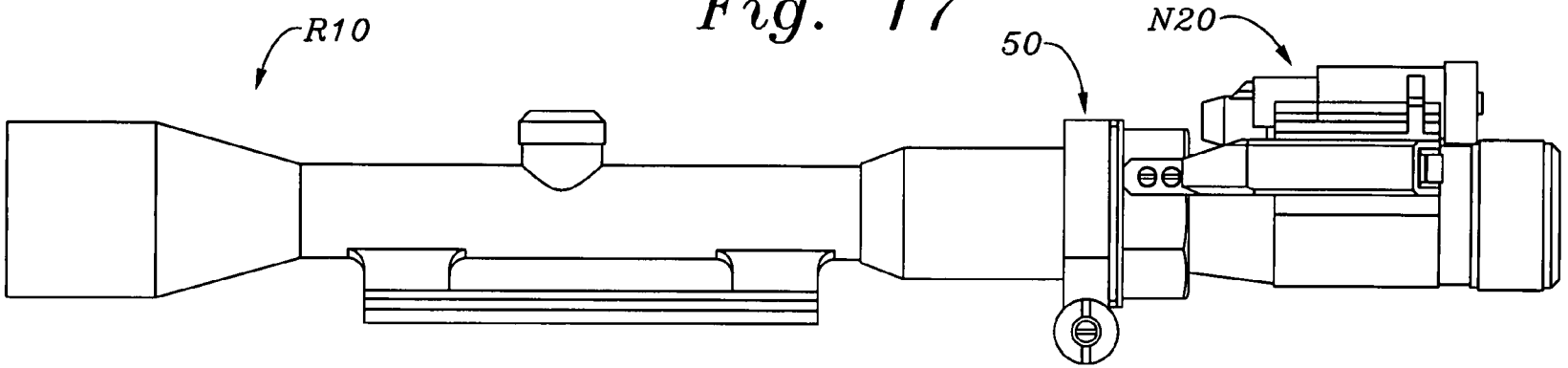
FIG. 17 is a left-side elevation view of the arrangement of FIG. 15.

FIGS. 9-14 illustrate a sequence of steps for releasably attaching an accessory optical device such as a night vision scope N20 to rear mounting ring 53 of clamping device. FIGS. 15-17 are various views of the night vision device N20 coupled in coaxial alignment with riflescope R10 by clamping device 50.

As may be seen best by referring to FIGS. 1-3 and 8, clamping device 50 optionally has on one or both arms 54L, 54R thereof, e.g., right arm 54R an accessory mount 200 for releasably mounting an accessory device such as an infrared illuminator. As shown in the figures, optional accessory mount 200 is of conventional design, comprising a rail structure which includes a longitudinally elongated rectangularly block-shaped base 201 which has a flat, horizontally disposed vertical wall surface 202. Base 201 of accessory mount 200 is secured with base surface 202 in flush contact to outer vertical wall surface 203 of a support arm 54, as by front and rear screws 204, 205 which are tightened into threaded bores 206, 207 through the base and into a pair of aligned threaded bores 208, 209 which extend perpendicularly inwardly into outer vertical wall surface 203 of the support arm.

As shown in the figures, accessory mount 200 has a pair of longitudinally disposed, upper and lower rails 210, 211 which protruded obliquely outwards from longitudinally disposed upper and lower edge corners 212, 213 of base 201. As may be seen best by referring to FIG. 3, rails 210, 211 have in transverse cross-section a triangular wedge shape. As may be seen best by referring to FIGS. 1 and 2, upper and lower rails 212, 213 are serrated or segmented into longitudinally spaced apart, transversely disposed, rectangular cross-section vertically disposed notches 214, 215. Notches 214, 215 are spaced at regular longitudinal intervals, have flat lower, vertically disposed base walls 216, 217, which are parallel to and spaced outwards from outer wall 218 of mounting base 201, and segment upper and lower rails 212, 213 into upper and lower rectangular-shaped, spaced apart rail segments 219, 220, respectively.

FIGS. 18-29 illustrate a single-arm, swing-away embodiment of a clamping device for coaxially coupling optical viewing devices to riflescopes, according to the present invention. The single-arm embodiment includes a front-mounting collar for releasably clamping coaxially around the ocular tube of a riflescope, as in the basic embodiment described above. The single-arm clamping device also has a rear-mounting ring for receiving and holding an optical device such as a night vision scope in coaxial alignment with a riflescope clamped in the front-mounting collar, and a single support arm protruding rearwardly from a side of the rear-mounting collar, the arm having a releasable fastener to secure it to the body of an optical device.

In the single-arm embodiment, the rear-mounting collar and support arm comprise an assembly that is pivotably joined to the front-mounting collar by a joint which has a vertical pivot axle positioned tangentially to an outer circumferential surface of the front-mounting collar. The pivot axle pivotably supports the rearwardly protruding device support arm, and a front support plate of the rear-mounting ring which protrudes perpendicularly inwards from an inner longitudinal surface of the support arm.

The front support plate of the rear-mounting ring extends radially outwards beyond a side of the rear-mounting ring opposite that of the support arm, and is releasably fastened to a rear outer circumferential wall surface of the front-mounting collar by a spring-loaded latch. In a latched position, the latch holds the rear-mounting ring in coaxial alignment with the front-mounting collar, securing an optical device such as a night vision device secured in the rear mounting ring to be used with the riflescope. The latch includes a pushbutton which is attached to a latch hook. The pushbutton and hook are biased by a spring to a radially outward position when the pushbutton is depressed, the hook pivots radially inwards from the front-mounting collar, thus disengaging the hook from a cylindrical pin which is disposed perpendicularly between a pair of ears that protrude radially outwards from the front support plate of the rear-mounting collar. Releasing the latch enables a torsion spring provided in the support arm pivot joint to pivot the arm forward, thus swinging the night vision device in an arc-shaped path away from coaxial alignment with the riflescope to a position outwards of the bore axis of the front-mounting collar, thus enabling sighting directly through the riflescope.

Referring to FIGS. 18-25, a pivotable-arm clamping or coupler device 250 for coaxially coupling optical viewing devices to a riflescope according to the present invention may be seen to include a split front mounting collar 251 which is substantially similar in construction to split front mounting collar 51 of the double arm clamping device of coupler 50 described above. Split front mounting collar 251 is adapted to coaxially receive the rear, ocular or eyepiece tube of a riflescope, and has a front clamp assembly 252A which secures the eyepiece tube within a split collar 261. Coupler 250 also includes an optical accessory device support arm 254 which is attached to an outer circumferential wall surface 255 of split collar 251 by a pivot joint 256 that is attached tangentially to the outer circumferential wall surface of the split collar.

Figure 19:
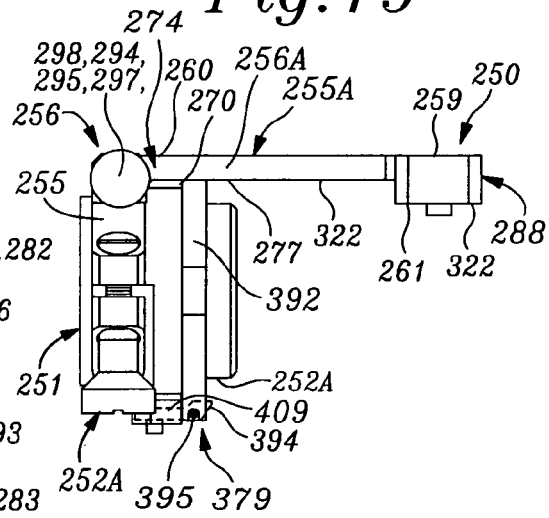
FIG. 19 is an upper plan view of the coupler of FIG. 18.

Support arm 254 has a flat, longitudinally disposed inner accessory-device mounting surface 322 which is disposed parallel to the longitudinal axis of front mounting collar 251, when the arm is pivoted to a first, latched position, as shown in FIG. 19. Support arm 254 also has projecting radially inwardly from a front longitudinally disposed wall surface 322A thereof a flat, transversely disposed front support plate 392 for a cylindrical ring-shaped rear tubular device mounting ring 253. Support plate 392 is secured in coaxial alignment with front mounting collar 251 by a latch 393 that includes a spring-loaded, push-button releasable hook 394, the latch being attached to an outer circumferential wall surface 258A of a rear solid cylindrically-shaped base ring 25B of front mounting collar 251.

Latch hook 394 releasably engages a pin 395 which is disposed perpendicularly between a pair of upper and lower ears 305, 306 that protrude radially outwards from an outer transverse end of the rear mounting ring support plate 392. Pin 395 is disposed in a tangential direction relative to the outer cylindrical surface 253A of rear mounting ring 253.

Figure 20:
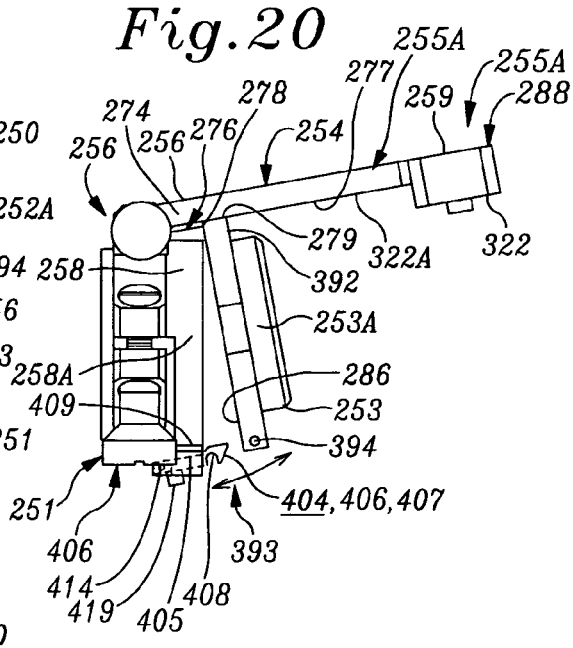
FIG. 20 is a view similar to that of FIG. 19, but showing a rear mounting arm thereof pivoted away from a front coupling clamp thereof.
Figure 27:
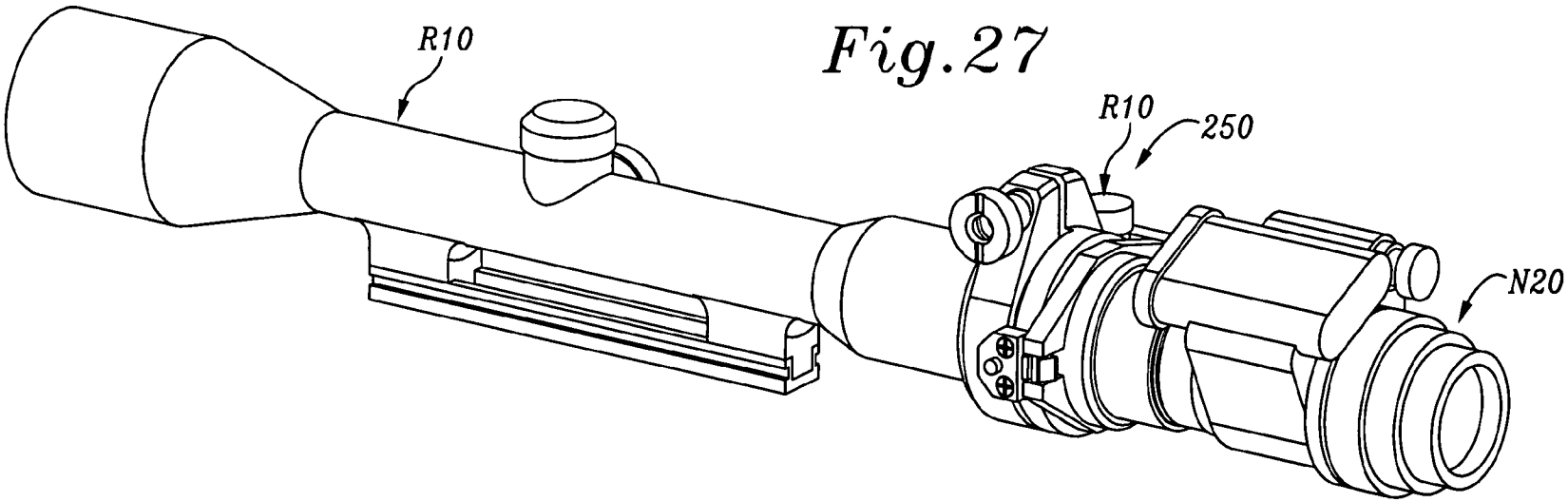
FIG. 27 is a view similar to that of FIG. 26, but showing the elements of FIG. 26 installed and connected together.

This construction enables arm 254 to be pivoted arcuately away from the longitudinal axis of front mounting collar 251, as shown in FIG. 20. Thus, as shown in FIGS. 27-29, an optical viewing device such as a night vision scope which is fastened to arm 254 is pivotable from a latched position in coaxial alignment with a riflescope, as shown in FIGS. 27 and 28, to an outwardly pivoted position, as shown in FIG. 29, enabling alternate viewing through the riflescope and night vision scope together, or the riflescope alone.

Since the structure and function of the front mounting collar 251 of coupler 250 are substantially similar to that of front mounting collar 50 described above, a description of that structure and function will not be repeated here. Elements of coupler 250 which are analogous to those of coupler 50 are designated by numbers incremented by 200.

As shown in FIGS. 18-25, optical accessory support arm 254 of coupler 250 has a skeletal or open frame construction, including an upper rectangular transverse cross-section, longitudinally disposed beam 255A which has a flat, horizontal upper surface 256A and a flat, horizontal lower surface 257A. Upper horizontal beam 255A terminates at a rear longitudinal end thereof in a device-attachment boss 288 which has in upper plan view a longitudinally elongated, rectangularly-shaped cross-section that has an outer longitudinally disposed vertical outer wall 259 which is coplanar with outer longitudinally disposed vertical wall 260 of the upper beam, as shown in FIG. 19.

As is shown in FIG. 19, device-attachment boss 288 has a longitudinally disposed vertical wall 261 which is offset inwardly towards a longitudinal center line of coupler 250, from inner longitudinally disposed vertical wall 262 of upper arm beam 255.

Figure 21:
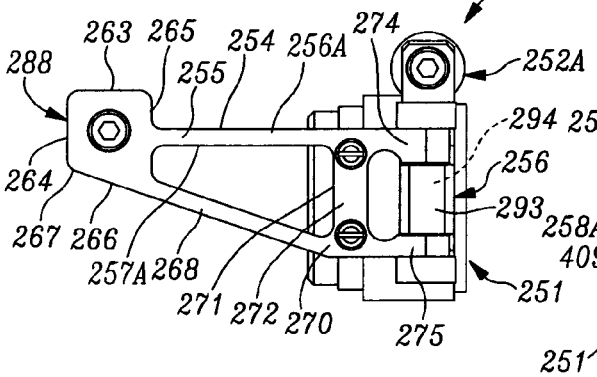
FIG. 21 is a right side elevation view of the coupler of FIG. 19.
Figure 24:
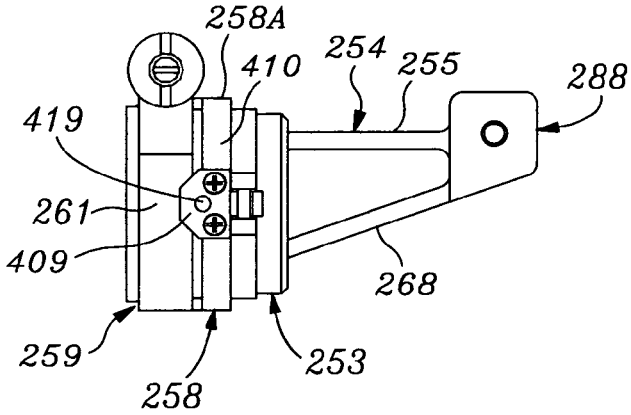
FIG. 24 is a left side elevation view of the coupler of FIG. 18.
Figure 22B:
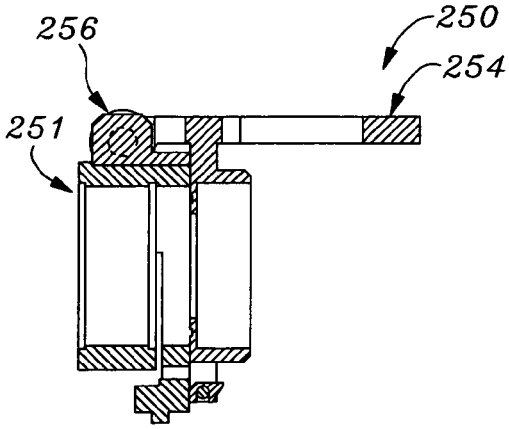
FIG. 22B is a downward sectional view from a horizontal medial plane of the coupler of FIG. 22, taken in the direction of line 22B-22B.

As may be seen best by referring to FIGS. 21 and 24, device attachment boss 258 has in side elevation view a trapezoidal shape, including an upper longitudinally disposed surface 263, a rear transversely disposed vertical surface 264 which depends perpendicularly downwards from the upper surface, a front transversely disposed vertical surface 265 which depends downwards from the upper surface parallel to but beyond the lower edge 267 of rear surface, and a lower transverse surface 266 which is disposed obliquely downwards from a lower edge 267 of the rear vertical surface to a lower edge 267A of the front vertical surface. Lower oblique surface 266 of boss 288 is coplanar with the lower surface of an obliquely angled lower diagonal beam 268 of arm 254, which has a rectangular transverse cross-section size and shape similar to those of upper horizontal beam 255A. Horizontal upper beam 255A and diagonal lower beam 268 terminate at front longitudinal ends 269, 270 thereof, in a rear transversely disposed vertical wall 271 of a front vertical strut 272 of arm 254.

As shown in FIG. 21, front vertical strut 272 has protruding longitudinally forward of a front vertically disposed transverse wall 273 of the strut parallel to upper and lower longitudinally disposed arm extensions 274, 275, respectively, which have a transverse thickness slightly greater than that of upper and diagonal arm beams 255A, 268. Thus, upper arm extension 274 has an inner longitudinally disposed vertical wall surface 276 which is offset a short distance inwards of inner longitudinally disposed wall surface 277 of upper horizontal arm beam 255A, forming at a vertical intersection therewith a thin, transversely disposed vertical edge wall or shoulder 278. The transversely disposed support plate 392 for tubular device mounting ring 253 has a flat, longitudinally disposed, vertical base mounting surface 279 which is fastened to inner vertical surface 280 of the front arm strut 272 in flush contact therewith, by suitable means such as upper and lower screws 280, 281, disposed through upper and lower bores 282, 223 through the strut into aligned blind threaded bores 284, 285 into the mounting surface of the support plate. As shown in the figures, a front transversely disposed surface 286 of rear mounting ring support plate 292 abuts shoulder 278.

Figure 18:
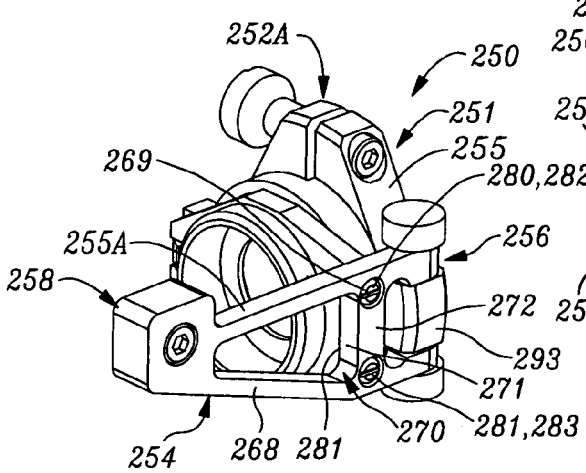
FIG. 18 is an upper perspective view of a single-arm, swing-away, embodiment of a releasable optical coupler according to the present invention.

As shown in FIGS. 18-20, pivot joint 256 which pivotably joins arm 254 to split front mounting collar 251 of coupler 250 includes a vertically elongated, generally rectangularly-shaped pivot axle journal 293 which is attached to outer circumferential wall surface 255 of the split front mounting collar. Pivot joint 256 includes a pivot axle 294 which is disposed vertically through vertically aligned bores 295 through upper arm extension 274, 296, through the pivot journal and 297 through lower arm extension 275. Axle 294 is secured vertically within the aforementioned bores by upper and lower, circular disk-shaped heads 298U, 298D, respectively. Thus constructed, pivot joint 256 enables arm 254, front support plate 292 and attached rear mounting ring 293 which protrudes rearwards from the support plate, to be pivoted counterclockwise away from front mounting collar 251, as shown in FIG. 20.

In a preferred embodiment, pivot joint 256 includes a torsion spring disposed between arm 254 and pivot axle journal 293, so that arm 254 is swung 180 degrees counterclockwise from a latched position relative to front mounting collar 251, as shown in FIG. 19, to a forward extending position, as shown in FIG. 29.

Figure 25:
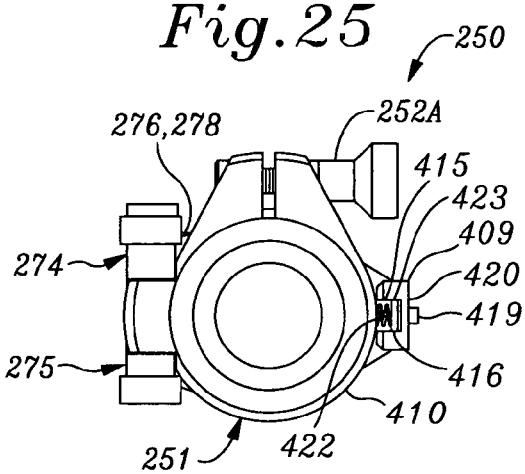
FIG. 25 is a front elevation view of the coupler of FIG. 18.
Figure 26:
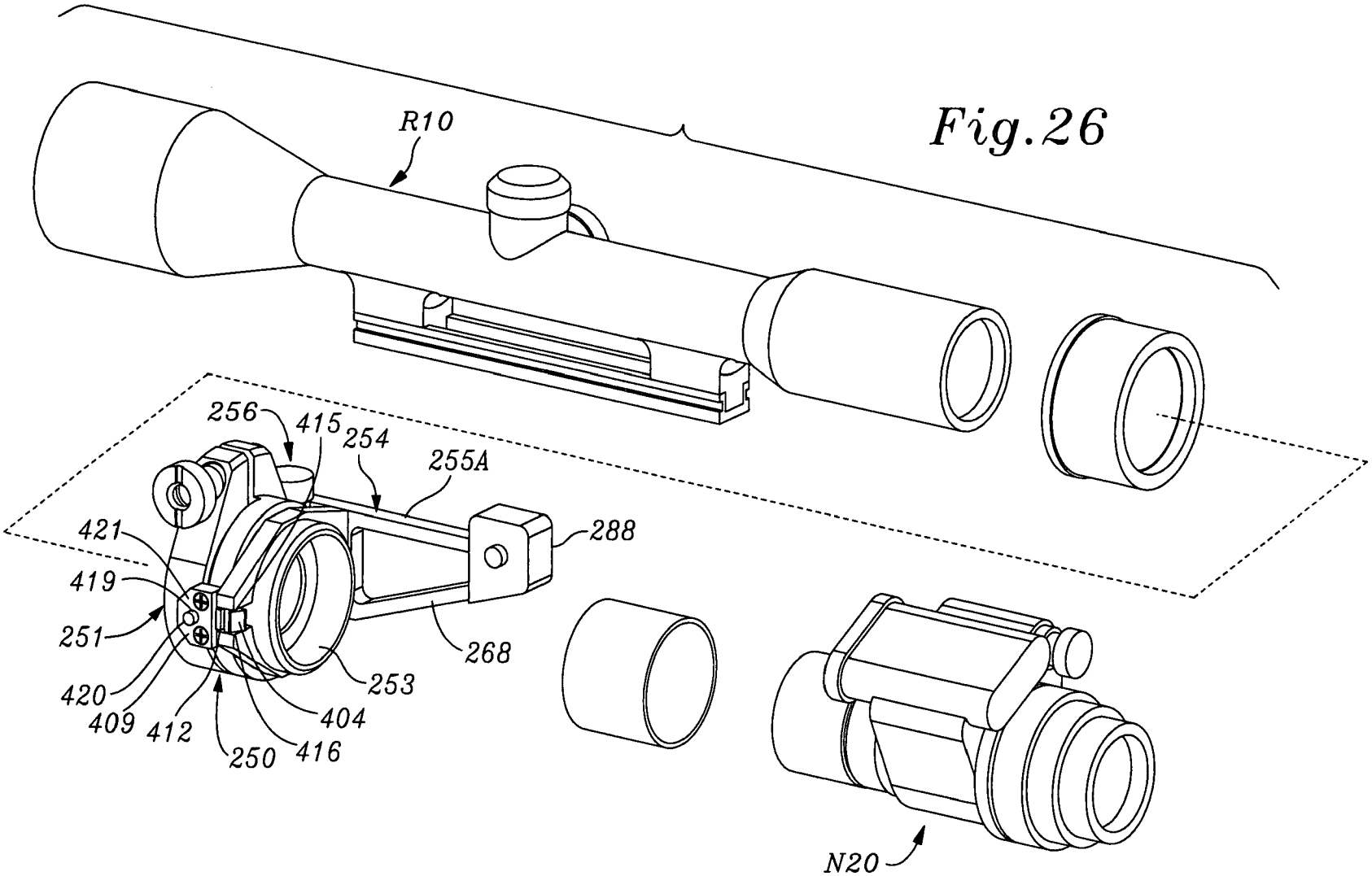
FIG. 26 is a left side perspective view of the coupler of FIG. 18, showing the coupler and an adapter bushing thereof positioned between a riflescope and a night vision device preparatory to using the coupler to join the riflescope to the night vision device.

As may be seen best by referring to FIGS. 20 and 24, latch 393 of coupler 250 includes a hook 404 that has the shape of an elongated rectangular bar 405 which has cut into a vertical face 406 of a rear end 407 of the bar, a groove 408. As shown in FIGS. 20, 24 and 25, bar 405 is mounted within a hollow vertically elongated, uniform transverse cross-section, trapezoidally-shaped boss 409 which is attached longitudinally to an outer circumferential wall surface 410 of a rear base ring 258A of front mounting collar 251.

As shown in FIG. 20, rear end 407 of latch hook 404 protrudes rearwardly through a slot 412 in a rear vertically disposed surface 413 of latch boss 409. The latch hook is pivotably mounted within boss 409 by a pivot pin 414 vertically disposed between upper and lower inner walls 415, 416 of slot 412. A forward end 417 of hook bar 405 located within slot 412 has protruding outwards from an outer vertical wall surface 418 thereof a pushbutton 419 which protrudes radially outwardly through a bore 420 through outer vertical wall 421 of boss 409, the bore communicating with a hollow open space 421 within the slot. Bar 405 of latch hook 404 is biased to a radially outwards, longitudinally disposed orientation by a compression spring 422 disposed between an inner surface 423 of the bar and an inner surface 424 of the slot.

Figure 22:
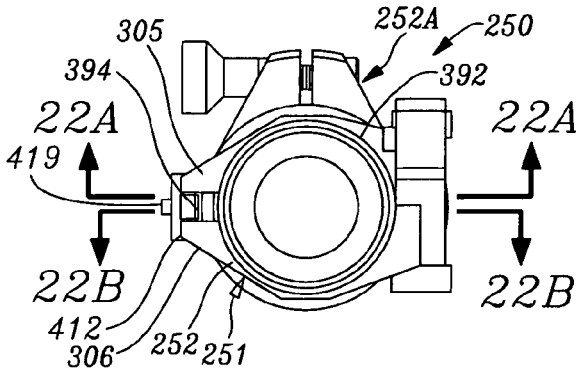
FIG. 22 is a rear elevation view of the coupler of FIG. 19.
Figure 22A:
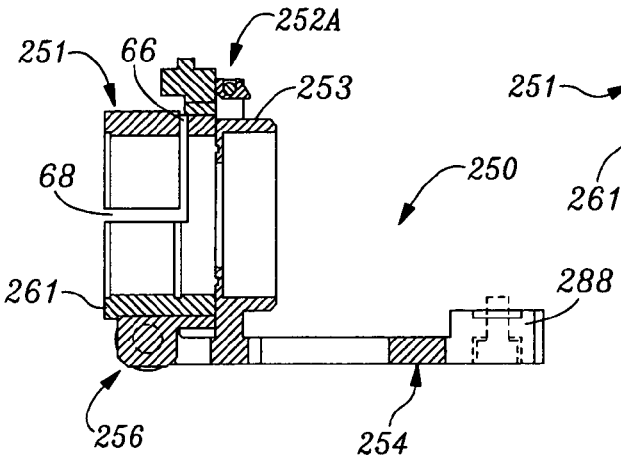
FIG. 22A is an upward sectional view from a horizontal medial plane of the coupler of FIG. 22, taken in the direction of line 22A-22A.
Figure 23:
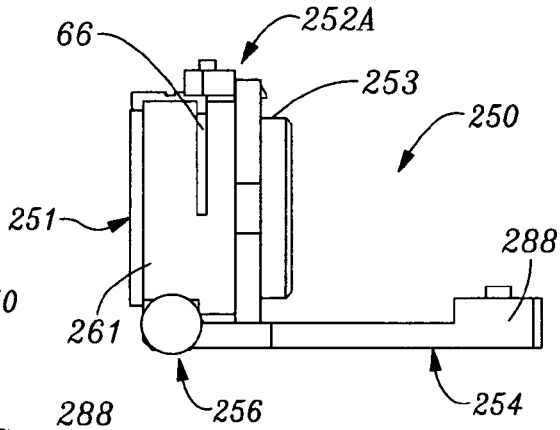
FIG. 23 is a lower plan view of the coupler of FIG. 18.

As shown in FIGS. 21 and 22, latch hook 404 releasably engages a pin 394 which is disposed perpendicularly between a pair of upper and lower ears 305, 306 that protrude radially outwards from an outer transverse end of the rear mounting ring support plate 392. Pin 394 is disposed in a tangential direction relative to the outer cylindrical surface 253A of rear mounting ring 253. This construction enables arm 254 to be pivoted arcuately away from the longitudinal axis of front mounting collar 251, as shown in FIG. 20. Thus, as shown in FIGS. 27-29, an optical viewing device such as a night vision scope N20 which is fastened to arm 254 is pivotable from a latched position in coaxial alignment with a riflescope, as shown in FIGS. 18 and 19, to an outwardly pivoted position, as shown in FIG. 29, enabling alternate viewing through the riflescope and night vision scope together, or the riflescope alone.

FIGS. 30-32 illustrate a modification 250A of the pivotable arm clamping device 250, which is provided with an accessory mount 200 of the type shown in FIGS. 18-29 and described above.

FIGS. 33-43 illustrate another embodiment of a single-arm, swing-away clamping device 450 for coaxially coupling a pair of optical devices, according to the present invention. That embodiment is similar in construction and function to the coupler 250 described above. However, coupler 450 differs from coupler 250 in that the coupler 450 has a two-position latch which is part of a pivot axle assembly. This construction enables an optical device to be alternatively latched at a rearwardly oriented, zero-degree latched use position rearward of a riflescope, and a forwardly directed, 180-degree latched swing-away position, in which latter position the optical device is swung forward along side the riflescope so that the riflescope can be viewed through directly.

As shown in FIGS. 33-43, dual latch position swing-away clamping device 450 for coaxially coupling a pair of optical devices include a split front mounting collar 451 which is substantially similar in construction and function to that of split front mounting collar 51 of the double arm clamping device 50 described above. Split front mounting collar 451 is adapted to coaxially receive a tubular part of a first optical device, such as the eyepiece tube of a riflescope, and has a front clamp assembly 452A for clamping the eyepiece tube within a split collar 452. Coupler 450 also includes an optical accessory device support arm 454 for supporting a second optical device, such as a night vision device, rearwardly of and coaxially aligned with the front optical device. Support arm 454 is attached to a rear cylindrical base ring 458A of front clamp assembly 452A by a pivot joint 456 which protrudes from an outer circumferential wall surface of the rear base ring.

Support arm 454 has a flat, longitudinally disposed inner accessory-device mounting surface 522 which is disposed parallel to the longitudinal axis of front mounting collar 451, when the arm is pivoted to a first, zero-degree latched position as shown in FIGS. 33-38. Support arm 454 also has projecting radially inwardly from a front end portion of an inner longitudinally disposed wall surface 522A thereof a flat, transversely disposed baffle plate 592 which has an annular ring shape. Arm 454 is secured in parallel alignment with the longitudinal center line of front mounting collar 451, and a center aperture of baffle plate 592 in coaxial alignment with the front mounting collar, by a latching mechanism comprising part of pivot joint 456, which is described in detail below.

Since the structure and function of front mounting collar 451 of coupler 450 are substantially similar to that of front mounting collar 50 described above, a description of that structure and function will not be repeated here. Elements of coupler 450 which are analogous to those of coupler 50 are designated by numbers incremented by 400.

Figure 35:
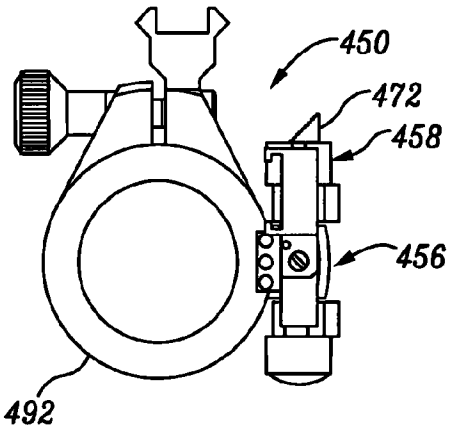
FIG. 35 is a rear view of the coupler of FIG. 33.
Figure 36:
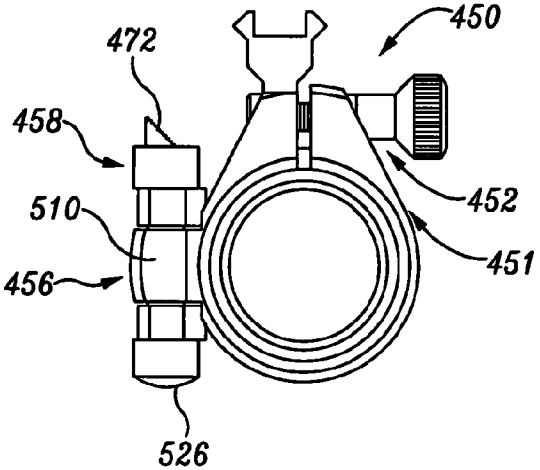
FIG. 36 is a front elevation view of the coupler of FIG. 33.
Figure 37:
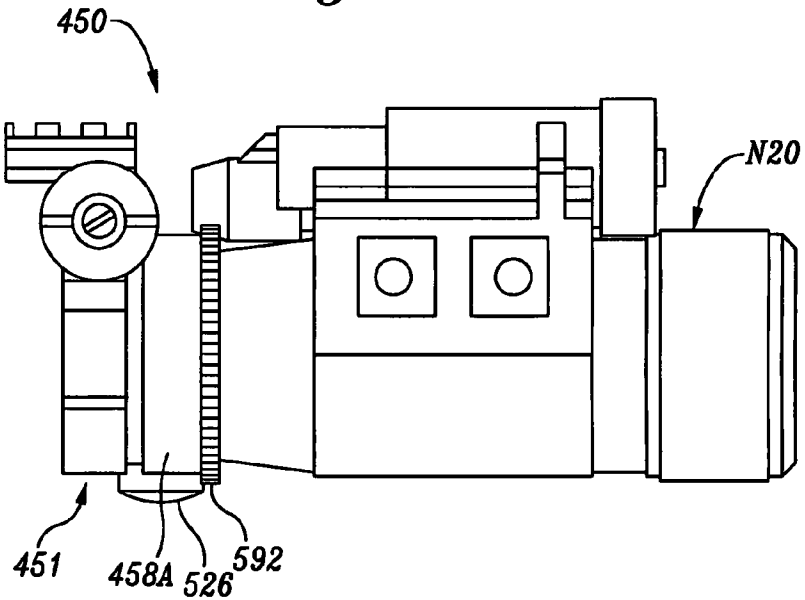
FIG. 37 is a left-hand elevation view of the coupler of FIG. 33, with an attached night vision device.
Figure 38:
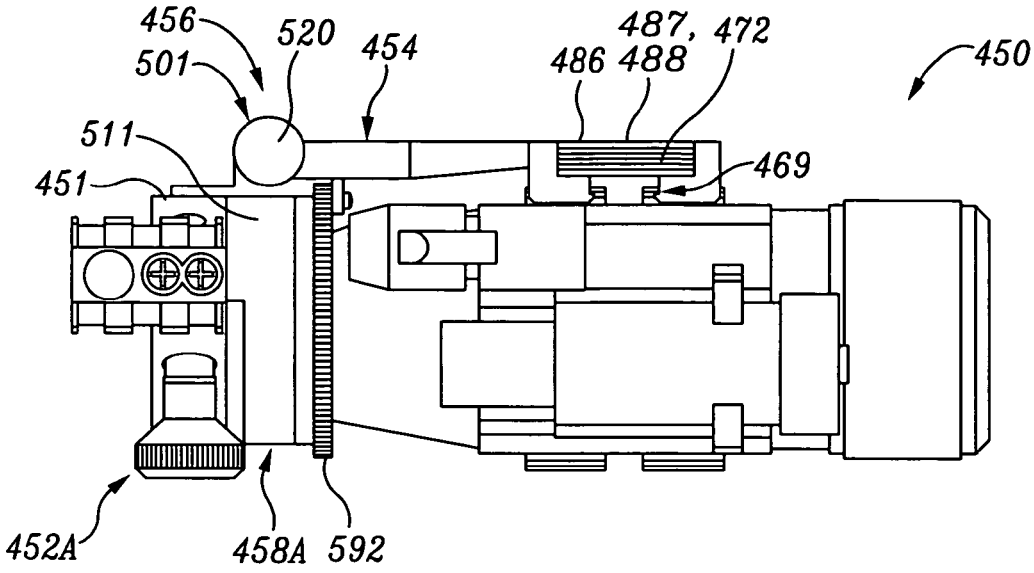
FIG. 38 is an upper plan view of the coupler of FIG. 33 with an attached night vision device.
Figure 39:
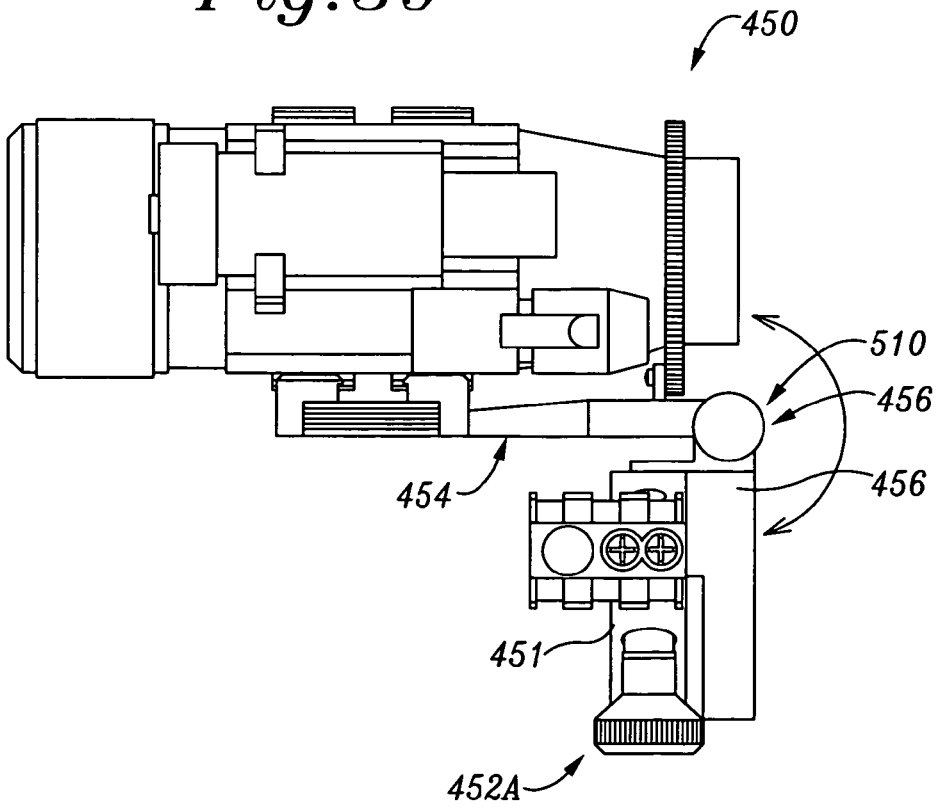
FIG. 39 is a view similar to that of FIG. 38, but showing an arm of the device swung away from a first, rearward latched position to a second, forward latched position.
Figure 40:
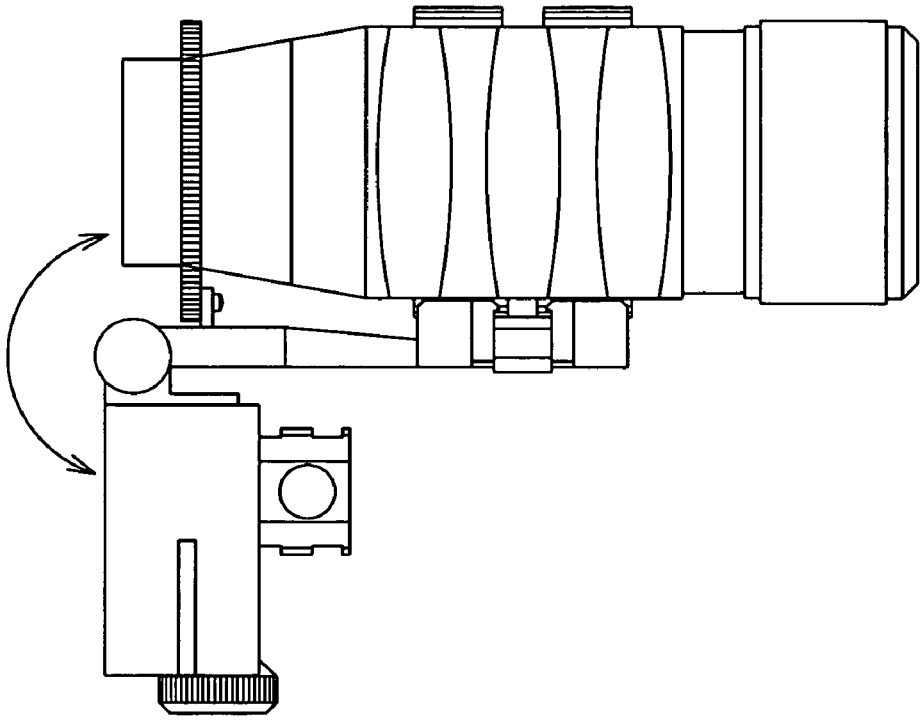
FIG. 40 is a lower plan view of the arrangement of FIG. 39.
Figure 41:
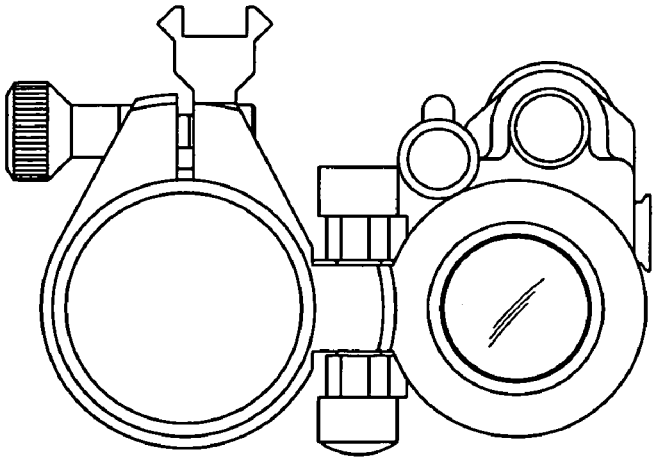
FIG. 41 is a front elevation view of the arrangement of FIG. 39.

As shown in FIGS. 33-38, optical accessory support arm 454 of coupler 450 has a skeletal or open frame construction, including an upper rectangular transverse cross section, longitudinally disposed beam 455 which has a flat, upper surface 456, and a flat lower surface 457 parallel to the upper surface. Upper horizontal beam 455 terminates at a rear longitudinal end thereof in a device-attachment block 458 which has in upper plan view a longitudinally elongated, rectangularly-shaped cross section that has an outer longitudinally disposed vertical wall 459 which is coplanar with outer longitudinally disposed vertical wall 460 of the upper beam, as shown in FIG. 37.

Figure 33:
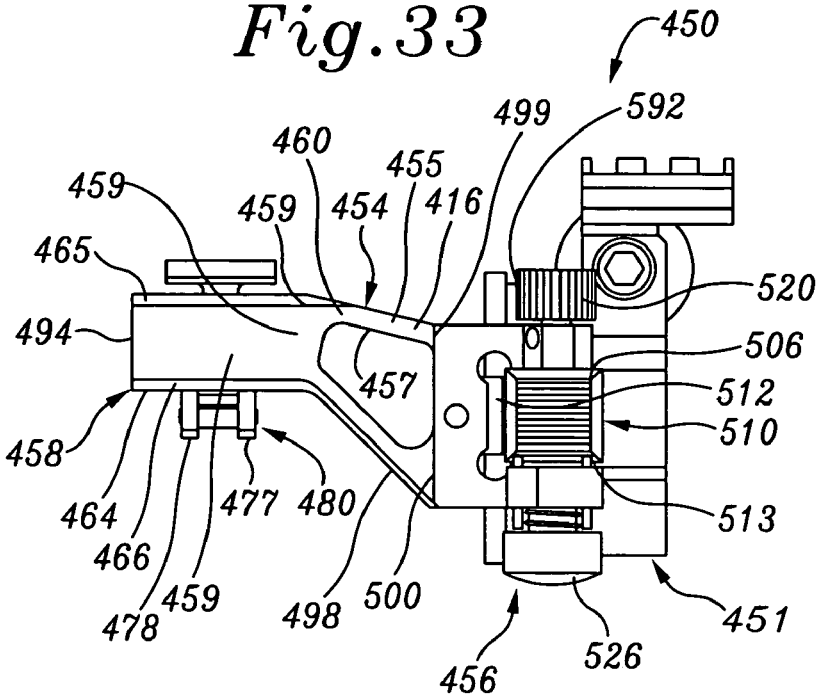
FIG. 33 is a right-hand elevation view of a two-position latching swing-away embodiment of a releasable optical coupler according to the present invention.
Figure 34:
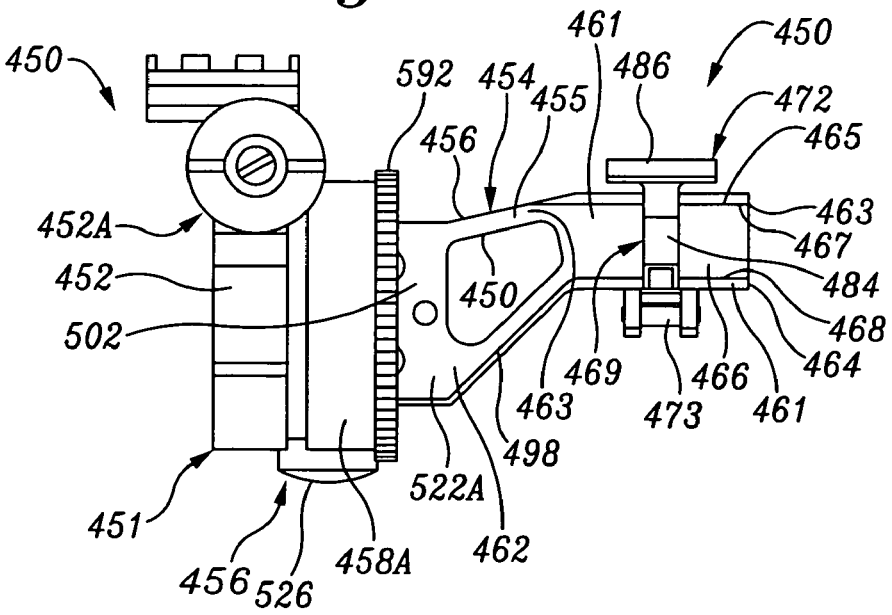
FIG. 34 is a left-hand elevation view of the coupler of FIG. 33.

As shown in FIGS. 33 and 34, device-attachment block 458 has a longitudinally disposed vertical wall 461 which is offset inwardly towards a longitudinal center line of coupler 450, from inner longitudinally disposed vertical wall 462 of upper beam 455.

As may be seen best by referring to FIGS. 33-35, device-attachment block 458 of coupler 450 has protruding laterally inwardly from upper and lower edges 463, 464 of inner vertical wall 461 thereof a pair of thin, vertically spaced apart longitudinally disposed, upper and lower longitudinally disposed flanges 465, 466. Flanges 465, 466 angle obliquely outwards and towards one another from inner vertical wall 461, forming therewith a pair of upper and lower dovetail grooves 467, 468, respectively. Dovetail grooves 467, 468 are adapted to longitudinally slidably receive forwardly therein upper and lower sides of dovetail flanges of an optical device, such as those on bosses of a night vision device N20 shown in FIGS. 9 and 10 and described above.

As shown in FIGS. 33 and 34, device attachment block 458 has formed in an inner vertical wall 461 thereof a longitudinally centrally located vertically elongated rectangular slot 469 which penetrates upper and lower horizontal edge walls 470, 471, as well as upper and lower flanges 465, 466 protruding from the upper and lower edge walls. Slot 469 holds movably and conformally therewithin a vertically elongated, rectangularly-shaped device locking lever 472. Device locking lever 472 is pivotably mounted at a lower end thereof to a pivot pin 473 disposed longitudinally between inner facing wall surfaces 474, 475 of a pair of longitudinally opposed vertically oriented faces 476, 477 of a vertical slot 478 formed in the front face 479 of a pivot boss 480 which protrudes downwardly from the lower face 481 of the device attachment block 458.

Device locking lever 472 is biased to a radially inwardly disposed position away from inner vertical wall surface 461 of attachment block 458, by a compression spring 482 disposed between an inner vertical surface 483 of the locking lever, and a bottom wall 489 of slot 469.

As shown in FIGS. 33 and 35, the upper end 485 of device locking lever 472 terminates in a longitudinally elongated thumb bar 486 which has a generally wedge-shaped transverse cross section, and has a plurality of longitudinally disposed, non-slip grooves 487 in an inner longitudinally disposed oblique wall 488 of the thumb bar. Thus constructed, thumb lever bar 486 may be pressed radially outwards to depress locking lever 472 into slot 469 sufficiently far for outer surface 489 of the lever to lie below outer wall surface 461 of block 458, thereby enabling the front boss of a pair of longitudinally spaced apart device bosses to slide forwardly within upper and lower dovetail grooves 467 and 468. The device is then secured to device attachment block 458 by releasing thumb pressure from thumb bar 486, thus enabling spring pressure to force locking lever 472 outwards from slot 469 and lodge between front and rear mounting bosses of the optical device.

Referring to FIGS. 33 and 34, it may be seen that device attachment block 458 has in side elevation view a longitudinally elongated, rectangular shape, including an upper horizontally disposed surface 463, a lower surface 464 parallel to the upper surface, a rear transversely disposed vertical surface 494, and a front transversely disposed vertical surface 495. Upper beam 455 of optical accessory support arm 454 protrudes forward from front surface 495 of device attachment block 458, preferably at a slight downward angle.

Arm 454 also has a lower beam 498 which has a cross-sectional shape and size similar to that of upper beam 455, the lower beam protruding forward from a front surface 495 of device attachment block 458 at a steeper angle than the upper beam. Upper and lower beams 455, 458 of support arm 454 terminate at front longitudinal ends 499, 500 thereof in a rear transversely disposed vertical wall 501 of a front vertical strut 502 of the arm. Strut 502 has parallel vertical inner and outer wall surfaces 503, 504 which are coextensive with inner and outer wall surfaces of upper and lower beams 455, 498 and has a front transversely disposed vertical wall surface 505 which is parallel to rear wall 501. Thus, strut 502 has a vertically elongated, rectangular block shape.

As shown in FIGS. 33 and 34, front vertical strut 502 has protruding longitudinally forward of a front transversely disposed vertical wall 503 thereof a pair of vertically spaced apart upper and lower longitudinally disposed extensions 504, 505 of upper and lower arm beams 455, 498, respectively. Baffle plate 592 is secured to front vertical strut 502 by flat, rectangularly-shaped vertically oriented and transversely disposed support bracket 506 which is attached at a front vertical wall surface 503 of the strut. Bracket 506 is located midway between upper and lower arm extensions 504, 505, and protrudes laterally inwards of inner longitudinal wall surface 509 of strut 502. An inner end of bracket 506 is attached to flat rear surface 508 of baffle plate 592, by blind rivets 509 or other similar fastening means.

As shown in FIGS. 33 and 36, pivot joint 456 which pivotably joins arm 454 to rear cylindrical base ring 458A of front clamp assembly 452A includes a generally rectangular block-shaped, vertically elongated pivot axle support boss 510 which protrudes radially outwardly from outer cylindrical wall surface 511 of the rear cylindrical base ring. Pivot axle support boss 510 has upper and lower parallel, transversely disposed horizontal wall surfaces 512, 513, respectively. A circular cross section pivot axle bore 514 is disposed through pivot axle support boss 510, the bore extending perpendicularly through upper and lower wall surfaces 512, 513 of the pivot axle support boss. Bore 514 through pivotal axle support boss 510 is parallel to a longitudinally disposed junction 515 between the pivot axle support boss and rear cylindrical base ring 458A of front clamp assembly 452A.

Figure 43:
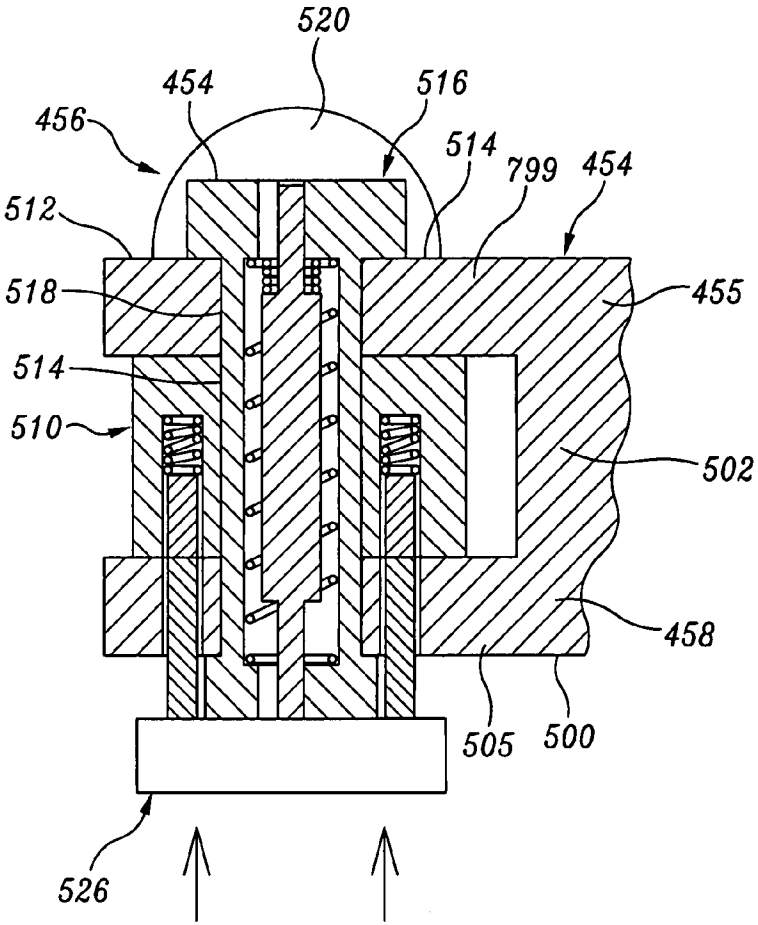
FIG. 43 is a view similar to that of FIG. 41 but showing the push button depressed to an unlatched release position.
Figure 42:
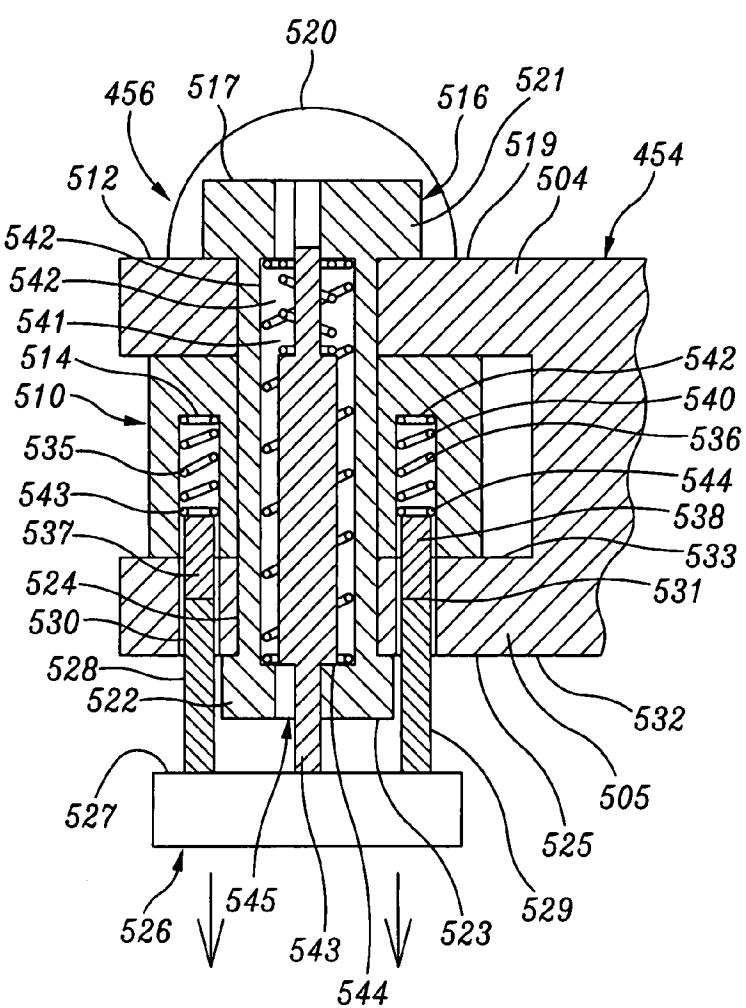
FIG. 42 is a vertical medial sectional view of a pivot joint of the coupler of FIG. 33, with a push button thereof in an upper latched position.
Figure 45:
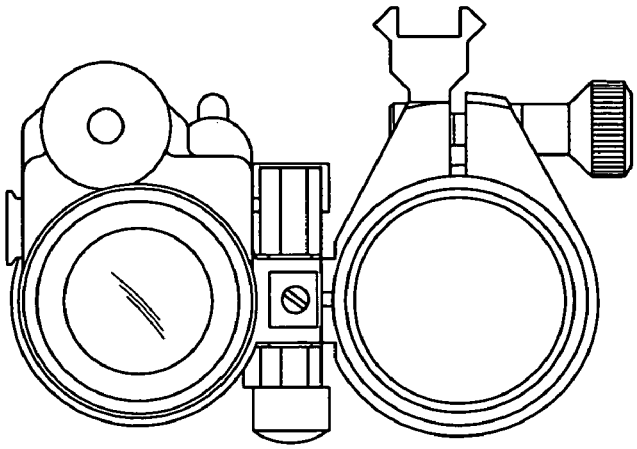
FIG. 45 is a front elevation view of the modified coupler of FIG. 44, showing a night vision device attached to the coupler arm and pivoted to a forward position.
Figure 44:
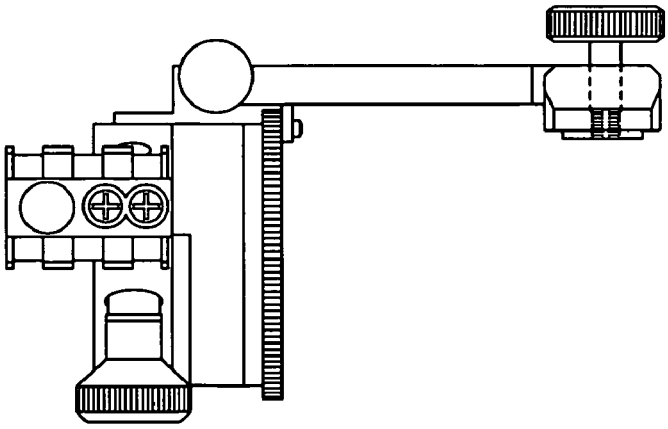
FIG. 44 is an upper plan view of a modification of the coupler of FIG. 33, showing a screw-type fastener arm thereof.
Figure 46:
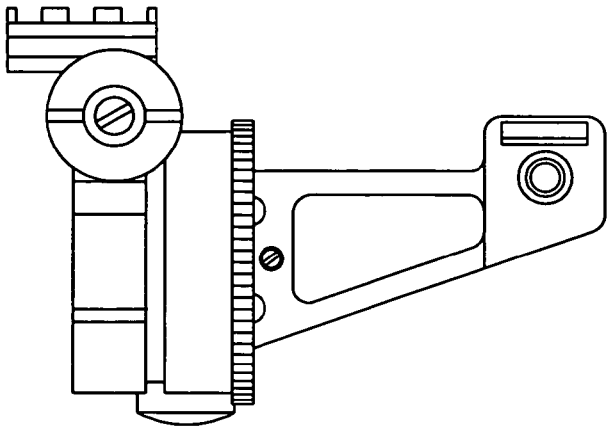
FIG. 46 is a left side elevation view of the coupler of FIG. 45.
Figure 47:
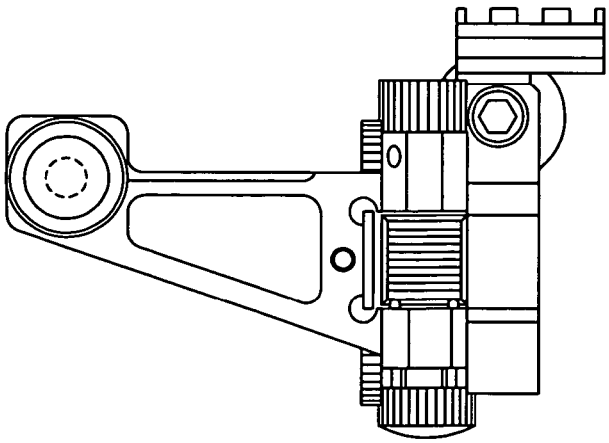
FIG. 47 is a right side elevation view of the coupler of FIG. 45.

Referring to FIGS. 42 and 43 in addition to FIGS. 33-36, it may be seen that pivot joint 456 includes a longitudinally elongated, cylindrically-shaped pivot axle 516 which is disposed through bore 514 of pivot axle support boss 510. Pivot axle 516 has an upper end 517 which protrudes upwardly through bore 514 and upwardly of face 512 of pivot axle support boss 510.

Upper end 517 of pivot axle 516 also protrudes through a bore 518 which extends perpendicularly through upper arm extension 504 of support arm 454, and upwardly of an upper surface 519 of the upper arm extension. A knurled upper retainer knob 520 having a generally cylindrical shape and larger diameter than bore 514 is secured to a portion of upper end 517 of pivot axle 516 which protrudes above upper arm extension 504.

As shown in FIGS. 42 and 43, pivot axle 516 has a hollow cylindrical shape, of a slightly smaller outer diameter than the diameter of bore 514 through axle support boss 510, thus enabling the axle to rotate within the bore. However, axle 516 is restrained against longitudinal motion within bore 514 by upper and lower annular ring-shaped end flange extension 521, 522, which have a larger outer diameter than the diameter of bore 514.

Pivot axle 516 has a lower end 523 which protrudes downwardly through bore 514 of pivot axle support boss 510, and downwardly of lower face 513 of the pivot axle support boss. Lower end 523 of pivot axle 516 also protrudes perpendicularly through a bore 524 provided through lower arm extension 505 of support arm 454, and downwardly of a lower surface 525 of the lower arm extension. A knurled push button knob 526 having a generally cylindrical shape and a diameter larger than that of upper retainer knob 520 is longitudinally slidably secured to the lower portion of lower end of a shaft extension 544 of a spring-loaded cylinder 543 longitudinally slidably held within pivot axle 516. The function of push button 526 and cooperating components of pivot joint 456 is to secure arm 454 alternately at zero-degree and 180-degree azimuth angle latched positions with the push button in a first, latched position, and to release the arm to enable it to pivot to an opposite latched position when the push button is actuated to a second, release position. Thus, as shown in FIGS. 42 and 43, push button 526 has protruding perpendicularly from an inner transversely disposed annular face 527 thereof a pair of axially disposed push button pins 528, 529 which are located on diametrically opposed locations on opposite sides of and parallel to pivot axle 516. Pins 528, 529 are longitudinally slidably received into a pair of arm bores 530, 531 which are axially aligned with the pins, the bores extending axially inwardly into lower face 532 of lower arm extension 505. Arm bores 530, 531 extend through the thickness dimension of lower arm extension 505, and extend through the upper face 533 of the lower arm extension.

As shown in FIGS. 42 and 43, pivot axle support boss 510 has extending upwardly into pivot axle support boss 510 from lower face 534 thereof a pair of blind cylindrical bores 535, 536 which are axially aligned with lower arm extension bores 530, 531, when the arm is positioned at either a zero-degree or 180-degree latched position.

Referring still to FIGS. 42 and 43, it may be seen that boss bores 535, 536 contain longitudinally slidably therewith a pair of latching pins 537, 538, respectively. Latching pins 537, 538 are biased outwardly to a latching position from bores 535, 536 by individual compression springs 539, 540 disposed between inner base faces 541, 542 of the bores and inner end faces 543, 544 of the latching pins. With latching pins 537, 538 biased outwardly from boss bores 535, 536, outer ends of the pins are received in arm bores 530, 531 of lower arm extension 505, as shown in FIG. 42. With this arrangement, arm 454 cannot pivot with respect to pivot axle support boss 510. However, when push button 526 is depressed, push button pins 528, 529 abut outer end faces of latching pins 537, 538 pushing the latching pins inwardly within boss bores 535, 536 until the abutting ends of the pushbutton pins and latching pins are coplanar with a bearing interface surface 540 between the upper surface of the lower extension 505 and the lower surface of pivot axle support boss 510, thus enabling pivotable motion of arm 454 between first and second latched positions.

As shown in FIGS. 42 and 43, push button 526 is preferably biased to a longitudinally outwards position on pivot axle 516 by a helical compression spring 541 located within a cylindrical cavity 542 located coaxially within the pivot axle. The spring exerts an axially outwardly directed force on a cylinder 543 located within cavity 542, the cylinder having a smaller diameter shaft extension 544 which protrudes from a transverse end 543A face of the cylinder and through a bore 545 through an outer transverse end 576 of the axle, an outer end of shaft extension 543 is fastened concentrically to an inner transverse face 527 of push button 526.

A preferred embodiment of coupler 450 is provided with a torsion spring which biases optical device arm 454 to a forward, 180-degree latched position when'push button 526 is depressed. With this arrangement, depressing push button 526 causes an optical device such as a night vision scope which was aligned behind a riflescope, to swing forward when the pushbutton is depressed, thus allowing immediate direct viewing through the riflescope.

FIGS. 44-47 illustrate a modification 450 of coupler 450, which utilizes a screw-type fastener 465A in place of dovetail groove flanges 465, 466.

What is claimed is:

1. A clamping device for coaxially coupling optical devices, said device comprising;

a. a first, front clamp assembly securable to a peripheral part of a housing of a first, front optical device, said front clamp assembly including a tubular front portion adapted to receive rearwardly therewithin a tubular rear portion of said first, front optical device, said tubular front portion of said clamp assembly including a split front collar portion comprised of a hollow cylindrical tube that is split into a pair of semi-cylindrically-shaped split collar halves by a longitudinally disposed slot which penetrates a front transversely disposed annular wall and inner and outer cylindrical wall surfaces of said tube, said tube having a front tubular portion partially severed from a rear solid cylindrical tubular base ring portion thereof by a thin transversely disposed slot which has a circumferential length of less than 360 degrees, and a tensioning structure for causing said split collar halves of said tubular front portion to resiliently exert a radially inwardly directed compressive force on an outer circumferential wall surface of a tubular rear portion of said first front optical device, b. an intermediate structure coupled to said front clamp assembly, said intermediate structure having a central bore adapted to receive coaxially with respect thereto a second, rear optical device with an optical axis of said second optical device coaxially aligned with an optical axis of said first, front optical device, and c. a releasable support structure coupled to said intermediate structure for releasably holding said second, rear optical device in coaxial alignment with said first, front optical device.

2. The clamping device of claim 1 further including a structure for exerting a radially directed resilient force between an inner peripheral surface of said tubular front portion of said front clamp assembly and an outer peripheral surface of a rear tubular portion of said first, front optical device.

3. The clamping device of claim 2 wherein said radial force exerting structure is further defined as including at least one resilient member lodgeable in an interference fit between an inner surface of said tubular front portion of said front clamp assembly and an outer surface of said rear tubular portion of said first, front optical device.

4. The clamping device of claim 3 wherein said resilient member is further defined as comprising a generally cylindrically-shaped bushing.

5. The clamping device of claim 4 wherein said bushing is made at least partially of an elastomeric material.

6. The clamping device of claim 1 wherein said tensioning structure is further defined as a bushing lodgeable between an outer cylindrical wall surface of a front optical device and inner circumferential wall surfaces of said semi-cylindrical split collar halves.

7. The clamping device of claim 6 wherein said bushing is further defined as being made of an elastomeric material.

8. The clamping device of claim 1 wherein said tensioning structure is further defined as including in combination first and second arms which protrude radially outwards from confronting circumferentially spaced apart portions of said first and second split collar halves, respectively, of said hollow cylindrical tube, and a threaded member disposed transversely through said arms for threadingly drawing said arms together circumferentially towards one another.

9. The clamping device of claim 8 wherein said split collar halves of said hollow cylindrical tube are biased resiliently apart from one another.

10. The clamping device of claim 9 wherein said tensioning structure is further defined as including a bushing lodgeable between an outer cylindrical wall surface of a front optical device and inner circumferential wall surfaces of said split collar halves.

11. The clamping device of claim 10 wherein said bushing is further defined as being made of an elastomeric material.

12. The clamping device of claim 1 wherein said releasable support structure for releasably holding said second, rear optical device is further defined as including in combination at least one elongated support arm which protrudes longitudinally rearward from said intermediate structure and a fastener for releasably attaching said arm to a housing of said second optical device.

13. The clamping device of claim 12 wherein said fastener is further defined as including a screw.

14. The clamping device of claim 12 wherein said fastener is further defined as including one of a dovetail groove and a dovetail flange.

15. The clamping device of claim 12 wherein said one of said dovetail groove and dovetail flange has a longitudinally disposed slide axis.

16. The clamping device of claim 12 further including a pivotable joint which couples said support arm to said intermediate structure, said pivotable joint enabling motion of said arm from a first position in which said second optical device is located behind and in coaxial alignment with said front optical device, to a second position in which said arm is pivoted away from said intermediate structure to thereby enable said second optical device to be swung away from a longitudinal axis of said first optical device and enable said front optical device to be viewed through directly.

17. The clamping device of claim 16 wherein said pivotable joint is further defined as comprising in combination;

a. a pivot axle support member for rotatably supporting a pivot axle, said support member attached to said intermediate structure, and b. a pivot axle rotatably disposed through said support member and attached to said support arm.

18. The clamping device of claim 17 further including a latching mechanism for latching said pivot axle and attached arm in at least a first pivotable location relative to said pivot axle support member.

19. A clamping device for coaxially coupling optical devices, said device comprising;

a. a first, front clamp assembly releasably clampable to a tubular housing of a first, front optical device, said front clamp assembly including a tubular front spit collar portion comprised of a hollow cylindrical tube which is split into a pair of first and second semi-cylindrically-shaped split collar halves by a longitudinally disposed slot that penetrates a front transversely disposed annular wall and inner and outer cylindrical wall surfaces of said tube, said tube having a front tubular portion partially severed from a rear solid cylindrical tubular base ring portion thereof by a thin transversely disposed slot which has a circumferential length of less than 360 degrees, said first and second split collar halves having protruding radially outwards from outer circumferential wall surfaces thereof first and second opposed radially disposed arms and having disposed through confronting inner circumferential spaced apart radially disposed faces thereof a threaded member for threadingly drawing said arms together, b. at least a first support arm which protrudes longitudinally rearwards from an outer circumferential wall surface of one of said split collar and said base ring of said front clamp assembly, and c. a fastener for releasably attaching said arm to a housing of said second optical device.

20. The clamping device of claim 19 further defined as including an aperture member having an aperture for coaxially receiving longitudinally forwardly therein a front tubular part of said rear optical device.

21. The clamping device of claim 19 further including a pivotable joint which couples said support arm to said base ring of said first, front clamp assembly, said pivotable joint enabling motion of said arm from a first position in which said second optical device is located behind and in coaxial alignment with said front optical device, to a second position in which said arm is pivoted away from said intermediate structure to thereby enable said second optical device to be swung away from a longitudinal axis of said first optical device and enable said front optical device to be viewed through directly.

22. The clamping device of claim 21 wherein said pivotable joint is further defined as comprising in combination;

a. a pivot axle support member for rotatably supporting a pivot axle, said support member attached to said base ring of said front clamp assembly, and b. a pivot axle rotatably disposed through said support member and attached to said support arm.

23. The clamping device of claim 22 wherein said support arm is further defined as having a pair of vertically opposed and spaced apart first and second forward extensions which are fastened to first and second ends of said pivot axle protruding outwards of first and second end faces, respectively, of said pivot axle support member.

24. The clamping device of claim 23 further including a latching mechanism for latching said pivot axle and attached arm at a first pivotable location relative to said pivot axle support member, said first latched position positioning said arm rearward of said base ring of said front clamp assembly.

25. The clamping device of claim 24 wherein said latching mechanism is further defined as including in combination;

b. at least a first support-member pin bore disposed through a face of said pivot axle support member, b. at least a first arm-extension pin bore disposed through a face of said arm extension and coaxially aligned with said support-member pin bore with said arm in said first latched position, c. at least a first locking pin located partially within said support-member bore, d. a first pin bias member for releasably maintaining said first latching pin partially within said support-member bore and said arm-extension bore to thereby prevent relative rotation movement of said arm extension relative to said pivot axle support member, and e. a pin driver member for moving said pin entirely into one of said support-member bore and arm-extension bore, thereby enabling rotation of said arm.

26. The clamping device of claim 25 wherein said first arm-extension bore is further defined as being located parallel to, and radially spaced apart of a first side of said pivot axle.

27. The clamping device of claim 25 further including a second support-member bore, second arm-extension bore, and a second locking pin, all coaxially aligned on an axis parallel to a longitudinal axis of said pivot axle and at a different azimuth angle than said first arm-extension bore.

28. The clamping device of claim 27 wherein said second arm-extension bore is spaced at a 180-degree azimuth angle with respect to said first arm-extension bore, thereby providing a second latched position in which said arm is located 180 degrees forward of said first latched position.

* * * * *